US008096442B2

(12) United States Patent
Ramundi

(10) Patent No.: US 8,096,442 B2
(45) Date of Patent: Jan. 17, 2012

(54) SOFT-SIDED INSULATED CONTAINER WITH THERMAL STORAGE MEMBER

(75) Inventor: Michael Ramundi, Kleinburg (CA)

(73) Assignee: California Innovations Inc. (CA)

( * ) Notice: Subject to any disclaimer, the term of this patent is extended or adjusted under 35 U.S.C. 154(b) by 532 days.

(21) Appl. No.: 12/249,634

(22) Filed: Oct. 10, 2008

(65) Prior Publication Data

US 2010/0089929 A1 Apr. 15, 2010

(51) Int. Cl.
*B65D 81/38* (2006.01)
*B65D 1/24* (2006.01)
*A45C 7/00* (2006.01)

(52) U.S. Cl. ..... 220/592.2; 220/552; 190/107

(58) Field of Classification Search ..... 206/577, 206/223, 216; 220/592.26, 666, 522, 521, 220/592.01, 4.28, 4.01, 657, 656; 190/107, 190/110, 109, 125, 124, 100; *B65D 81/38, B65D 1/24, 1/36; A47J 41/00; A45C 7/00*
See application file for complete search history.

(56) References Cited

U.S. PATENT DOCUMENTS

| | | | | |
|---|---|---|---|---|
| 853,404 | A * | 5/1907 | Gilbert | 190/110 |
| 5,332,093 | A * | 7/1994 | Littlepage | 206/457 |
| 6,179,182 | B1 * | 1/2001 | Hayes | 224/408 |
| 6,238,091 | B1 * | 5/2001 | Mogil | 383/110 |
| 6,776,271 | B2 * | 8/2004 | Chen | 190/18 A |
| 7,162,890 | B2 * | 1/2007 | Mogil et al. | 62/457.7 |
| 7,669,436 | B2 | 3/2010 | Mogil et al. | 62/457.7 |
| 7,757,878 | B2 | 7/2010 | Mogil et al. | 220/592.2 |
| 7,841,207 | B2 | 11/2010 | Mogil et al. | 62/457.7 |
| 2001/0035319 | A1 * | 11/2001 | Clements et al. | 190/109 |
| 2005/0194227 | A1 * | 9/2005 | Mitchell et al. | 190/18 A |
| 2005/0205459 | A1 | 9/2005 | Mogil et al. | 206/545 |
| 2005/0224304 | A1 * | 10/2005 | Bhavnani | 190/107 |
| 2009/0095757 | A1 | 4/2009 | Ramundi | 220/592.2 |
| 2010/0116830 | A1 | 5/2010 | Mogil et al. | 220/592.2 |
| 2010/0282763 | A1 | 11/2010 | Mogil et al. | 220/592.2 |
| 2011/0127274 | A1 | 6/2011 | Mogil et al. | 220/592.2 |

* cited by examiner

*Primary Examiner* — Mickey Yu
*Assistant Examiner* — Robert J Hicks
(74) *Attorney, Agent, or Firm* — Ostrolenk Faber LLP

(57) ABSTRACT

A portable, foldable, soft-sided insulated container has an a lid mounted carrier, or seat, for a substantially rigid container of a thermal storage medium, such as water. The container assembly may be free of any rigid tub, and may thus retain the ability to fold. The carrier is a substantially rigid plate or panel, or array, that mounts to an otherwise soft panel. The panel, or portion of a panel, to which the rigid carrier mounts is a panel that may tend to stay substantially flat (or curved) when the container assembly is folded. The mounting is such that the substantially rigid thermal storage medium container can slide in and out of the seat. When not in use the entire assembly can be folded into a collapsed position for storage.

8 Claims, 27 Drawing Sheets

SOFT-SIDED INSULATED CONTAINER WITH THERMAL STORAGE MEMBER

FIELD OF INVENTION

This invention relates to the field of soft sided insulated containers. In particular it relates to soft sided insulated containers having removable impermeable liners for discouraging or preventing the leakage of liquids.

BACKGROUND OF INVENTION

Soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer, pop, juices, and milk. Where cooling is desired, such as for canned beverages, the cooler may tend also to carry ice. The containers are typically made in a generally cube like shape, whether of sides of equal length or not, having a base, four upstanding walls, and a top. The top is generally a lid which opens to permit articles to be placed in, or retrieved from, the container.

By the nature of their use, it is advantageous for the containers to be water tight. That is, whether to hold melted run-off from ice cubes or to hold spilled liquids, the container must be sufficiently liquid tight that it does not leave a trail of drips, or become moist or sticky to the touch of a person carrying the container.

The use of loose ice within the container may be problematic. It may be desirable to employ a thermal energy storage member, such as an ice pack or a heating pack. It may be desirable to employ a pack that is easily inserted or removed, and yet that is retained in an unobtrusive location.

SUMMARY OF INVENTION

In an aspect of the invention there is a collapsible, soft-sided insulated container assembly. It has a soft sided insulated wall structure that includes a plurality of sides mutually connected along vertices. The wall structure has folds along which the wall structure may be moved between a first position, that first position being a folded position, and a second position, that second position being an expanded position in which the wall structure defines an insulated chamber of the container into which object may be placed. The wall structure includes a closure member movable between open and closed conditions to govern access to the insulated chamber. The wall structure includes a first fabric wall portion has a width, a breadth, and a thickness, the thickness being less than half of either the width or the breadth. The first fabric wall portion includes an inner skin, an outer skin, and a layer of insulation located between the inner skin and the outer skin. There is a substantially rigid thermal storage member; and a substantially rigid thermal storage member seat. The thermal storage member seat includes a land conforming to the first fabric wall portion of the wall structure. It is mounted adjacent to the inner skin thereof such that the thermal storage member seat is, in use, oriented inwardly relative to the insulated chamber. The thermal storage member seat includes a guide, the guide being mounted proud of the inner skin of the fabric wall portion. The thermal storage member is slidingly engageable with the guide in a direction predominantly cross-wise to the first fabric wall portion.

In a feature of that aspect of the invention, the first fabric wall portion is oriented such that when the closure member is in the open condition the thermal storage member is exposed and slidably disengageable from the guide array. In another feature, the first fabric wall portion defines a lid panel of the container assembly. In still another feature, the thermal storage member seat includes a pair of guide members defining a track, and the thermal storage member has mating fittings operable to engage and run along the track. In still another feature, the first fabric wall portion remains substantially flat when the assembly is moved to the first position.

In a further feature, the first fabric wall portion is a sub-portion of a larger wall panel. In still another feature, the first fabric wall portion is substantially planar and defines a top wall of the assembly, the top wall being hingedly movable to define the closure member. The seat is substantially planar. The seat is mounted to, and is substantially parallel to, the top wall. The thermal storage member is movable substantially sideways relative to the top wall to engage and disengage the seat.

In yet another further the first fabric wall portion is substantially planar and defines a top wall of the assembly, the top wall being hingedly movable to define the closure member; the seat being substantially planar. The seat is mounted to, and is substantially parallel to, the top wall. The thermal storage member being movable substantially sideways relative to the top wall to engage and disengage the seat.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION

Figure 1A:
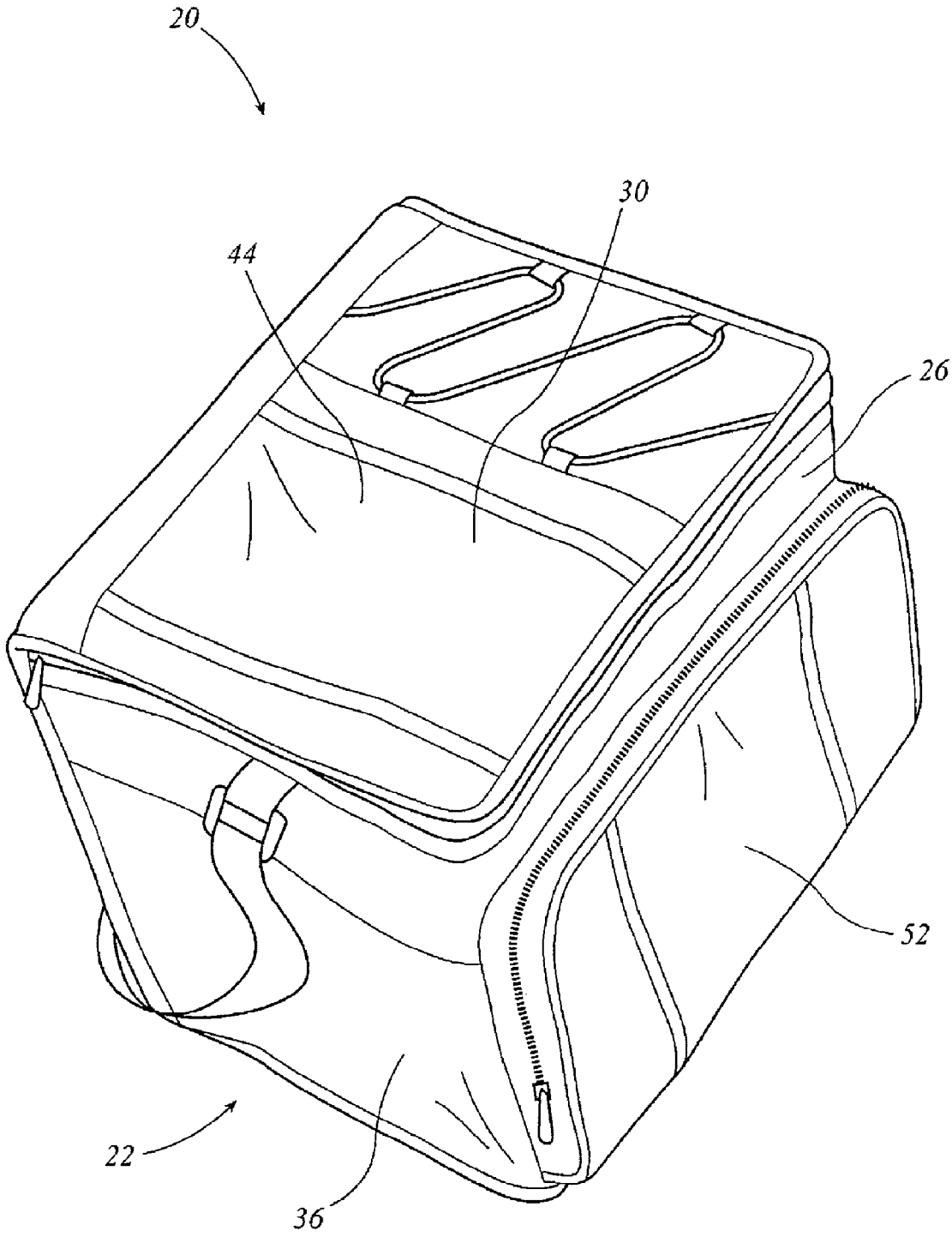
FIG. 1*a* is a general arrangement perspective view taken from in front, above and to the right side of a collapsible insulated container assembly according to an aspect of the present invention.
Figure 1B:
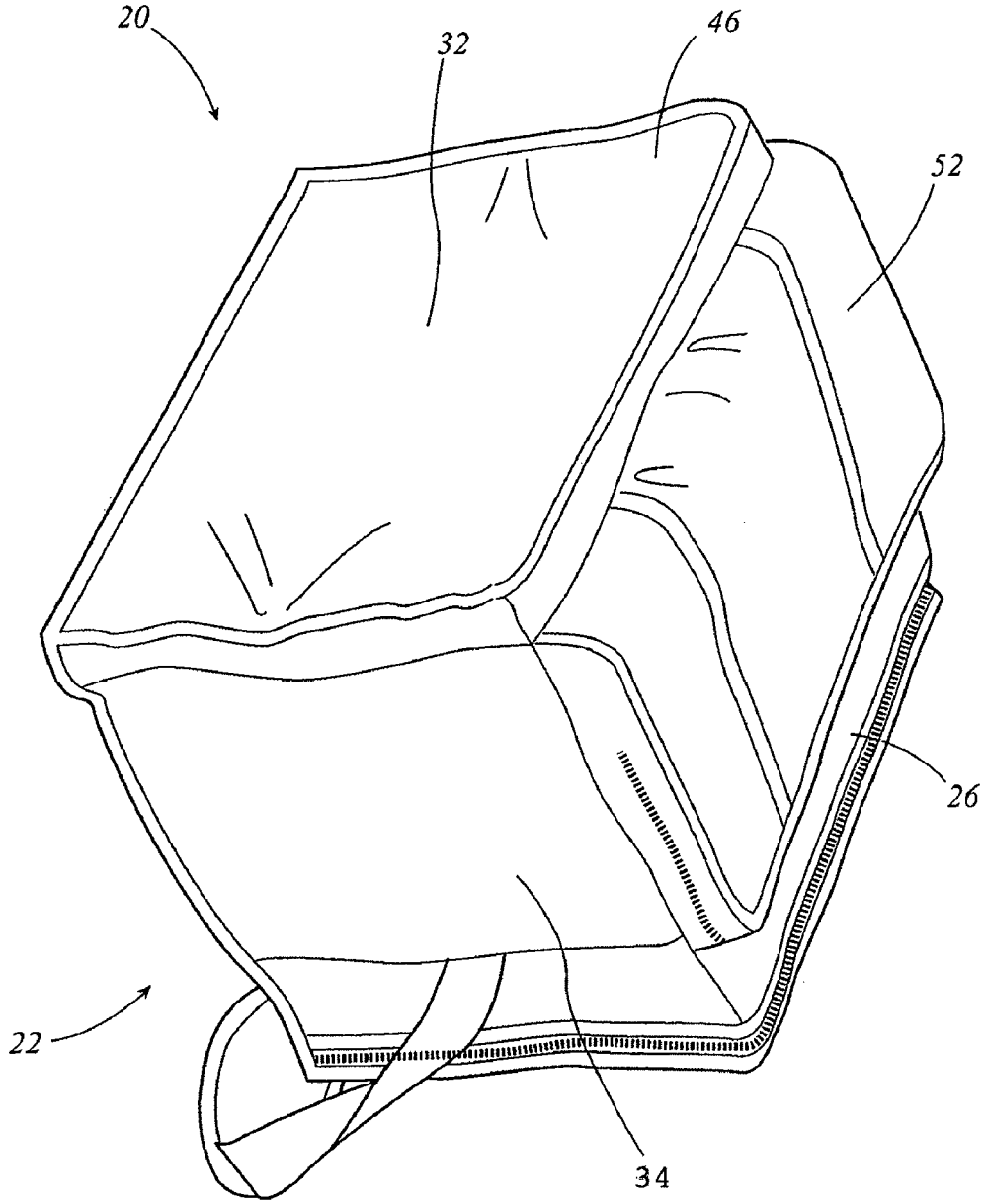
FIG. 1*b* is a perspective view of the assembly of FIG. 1*a*, taken from behind, below, and to the left side thereof.
Figure 1C:
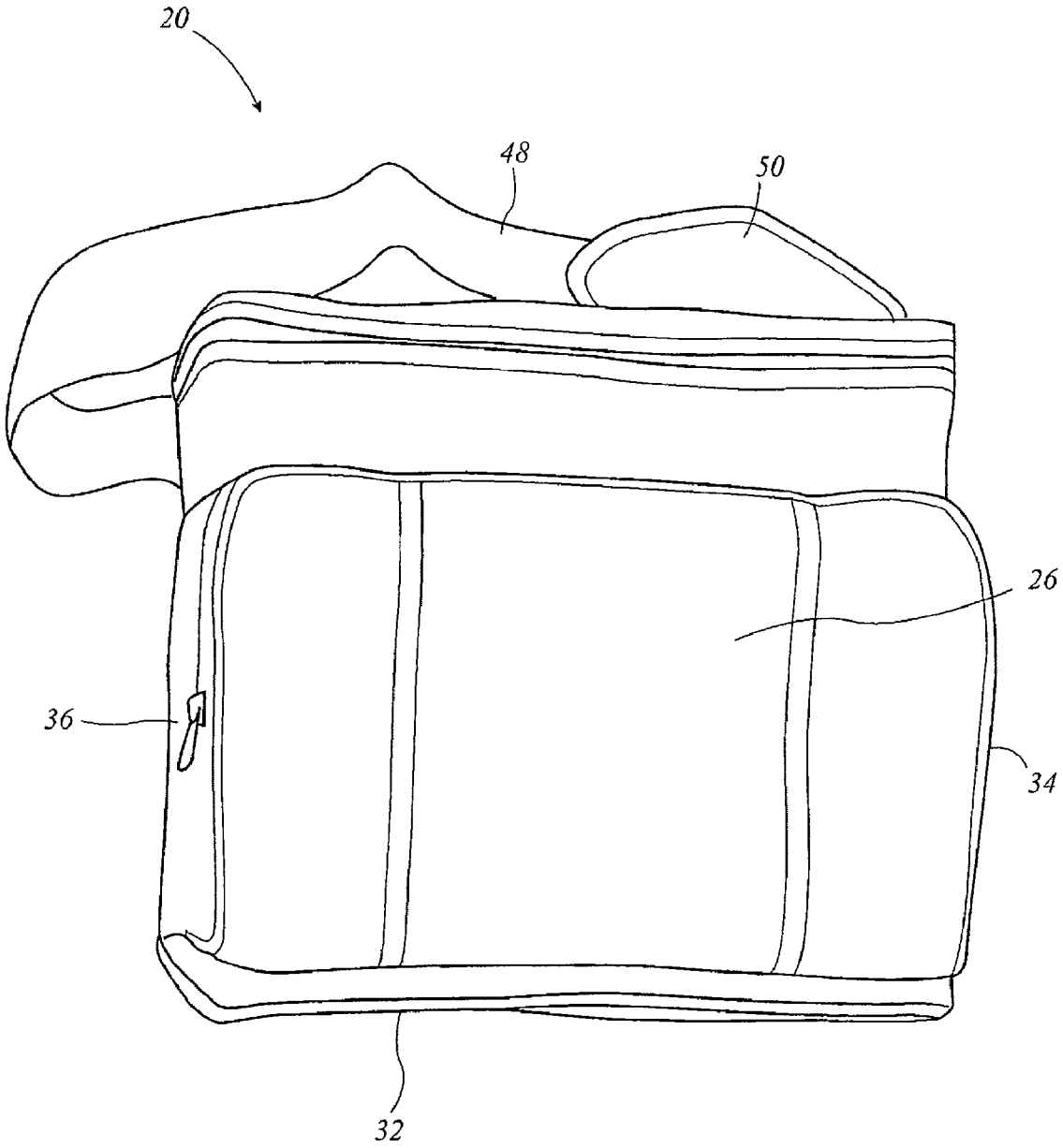
FIG. 1*c* is a front view of the insulated container assembly of FIG. 1*a*.
Figure 1D:
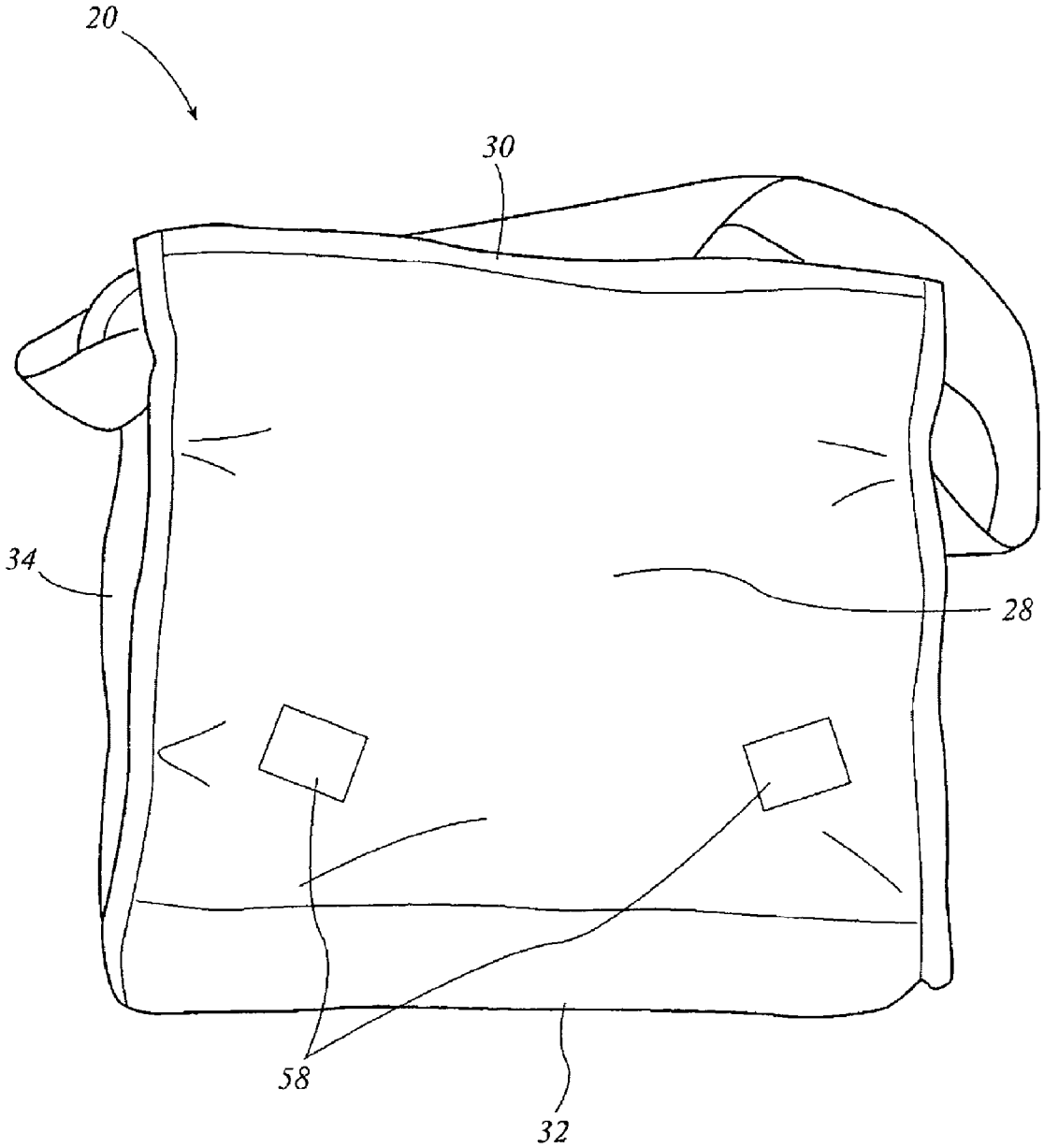
FIG. 1*d* is a rear view of the insulated container assembly of FIG. 1*a*.
Figure 1E:
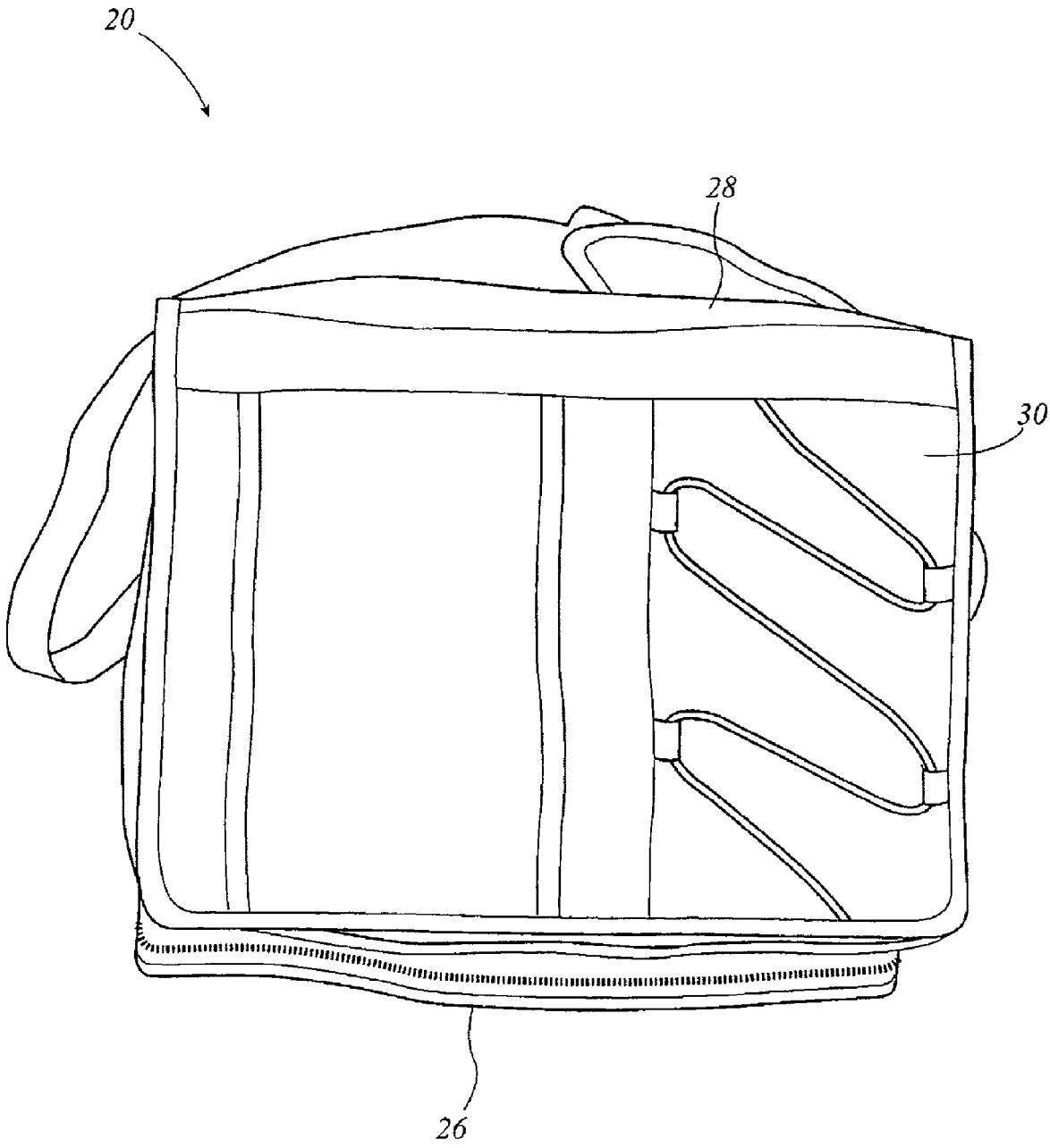
FIG. 1*e* is a top view of the container assembly of FIG. 1*a*.
Figure 1F:
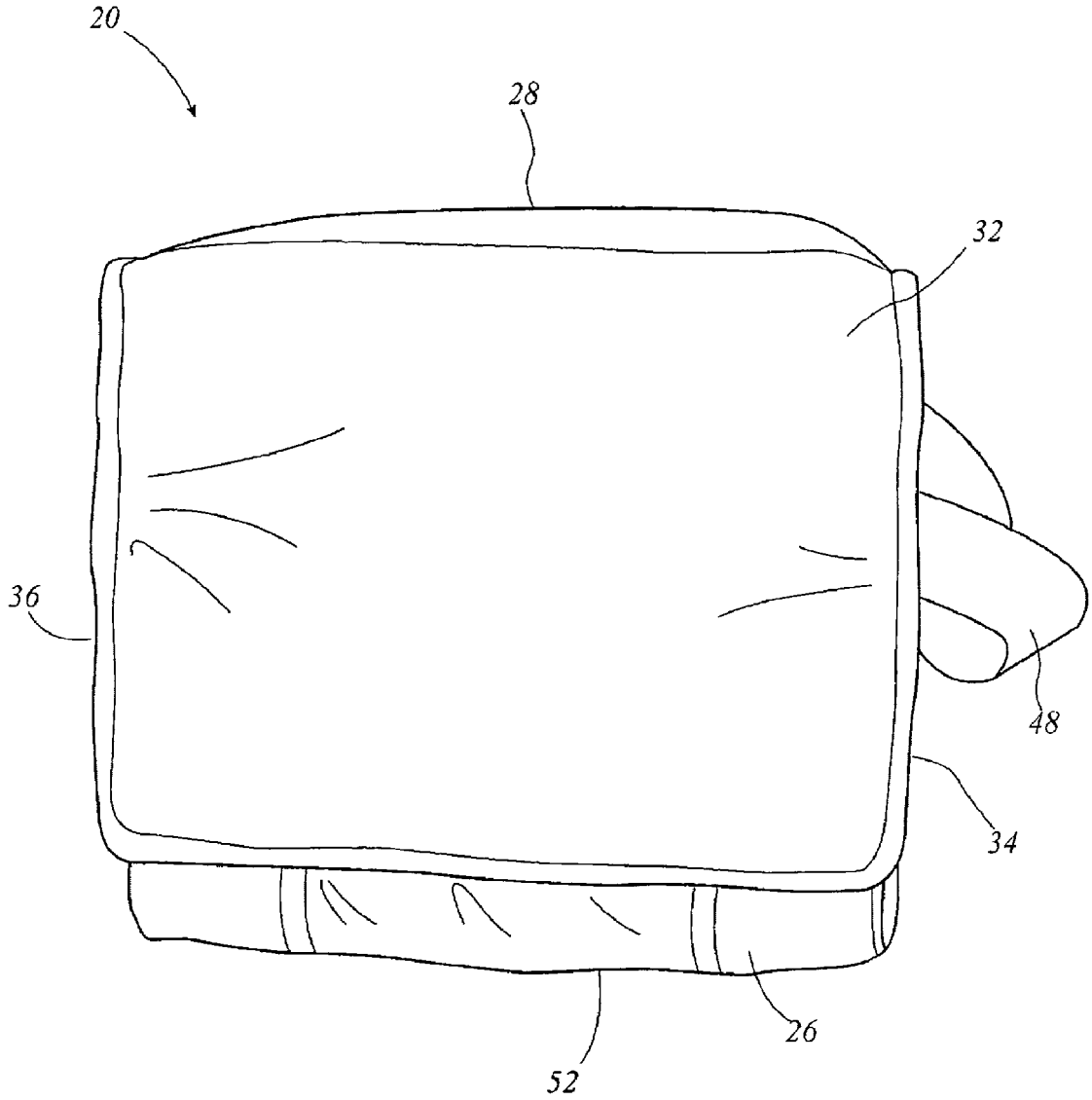
FIG. 1*f* is a bottom view of the container assembly of FIG. 1*a*.
Figure 1G:
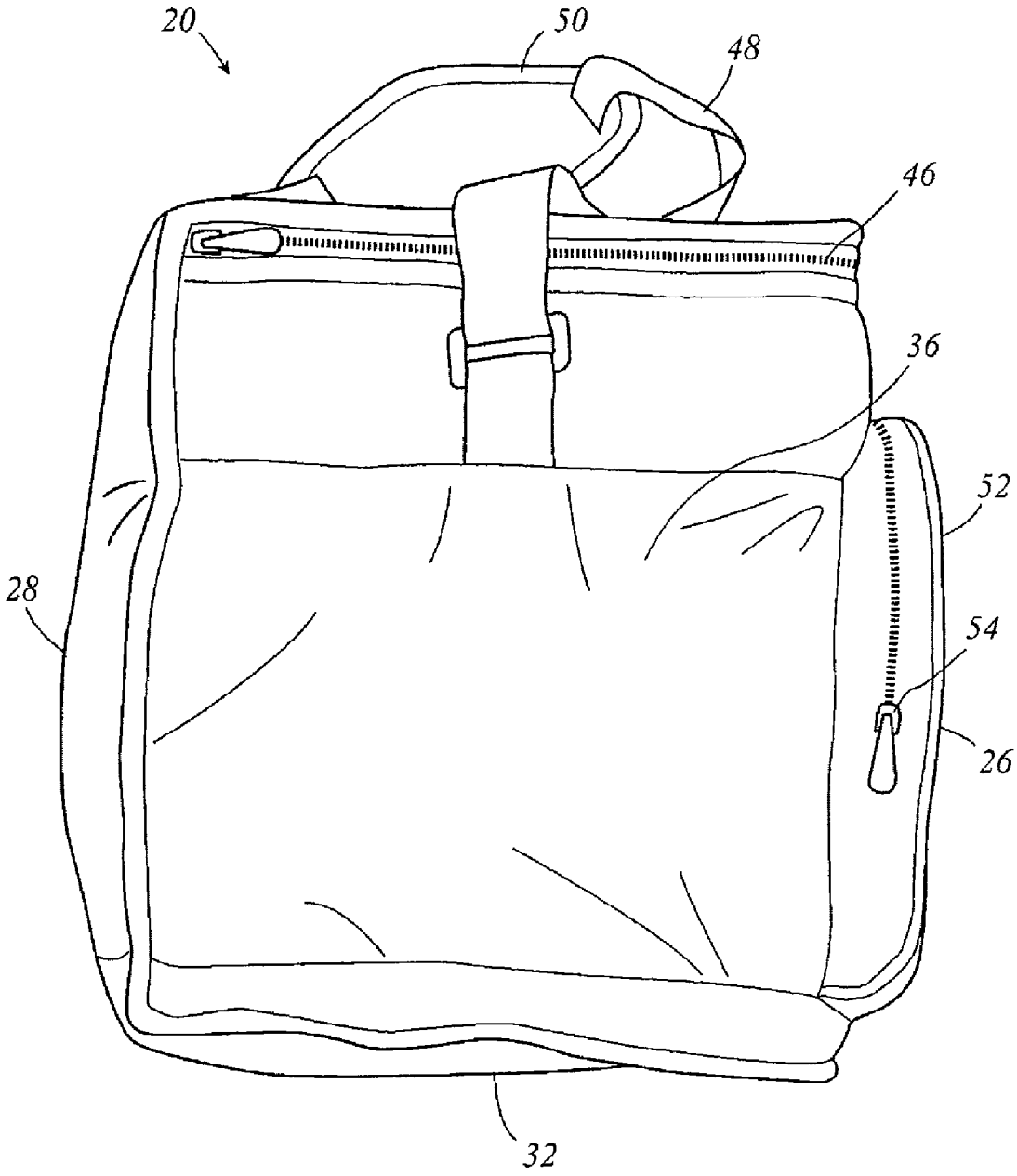
FIG. 1*g* is a right hand side view of the container assembly of FIG. 1*a*.
Figure 1H:
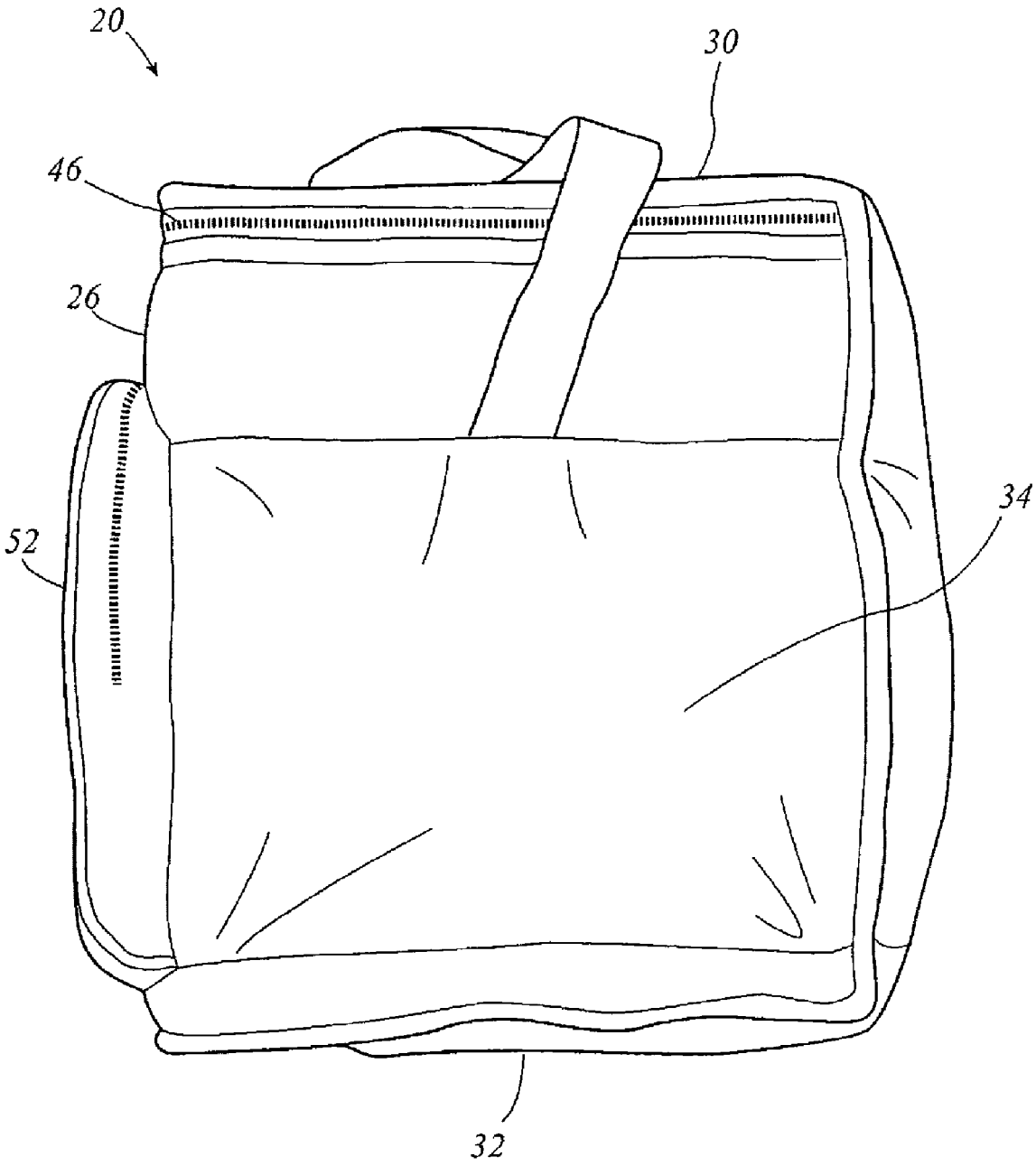
FIG. 1*h* is a left hand side view of the container assembly of FIG. 1*a*.
Figure 2A:
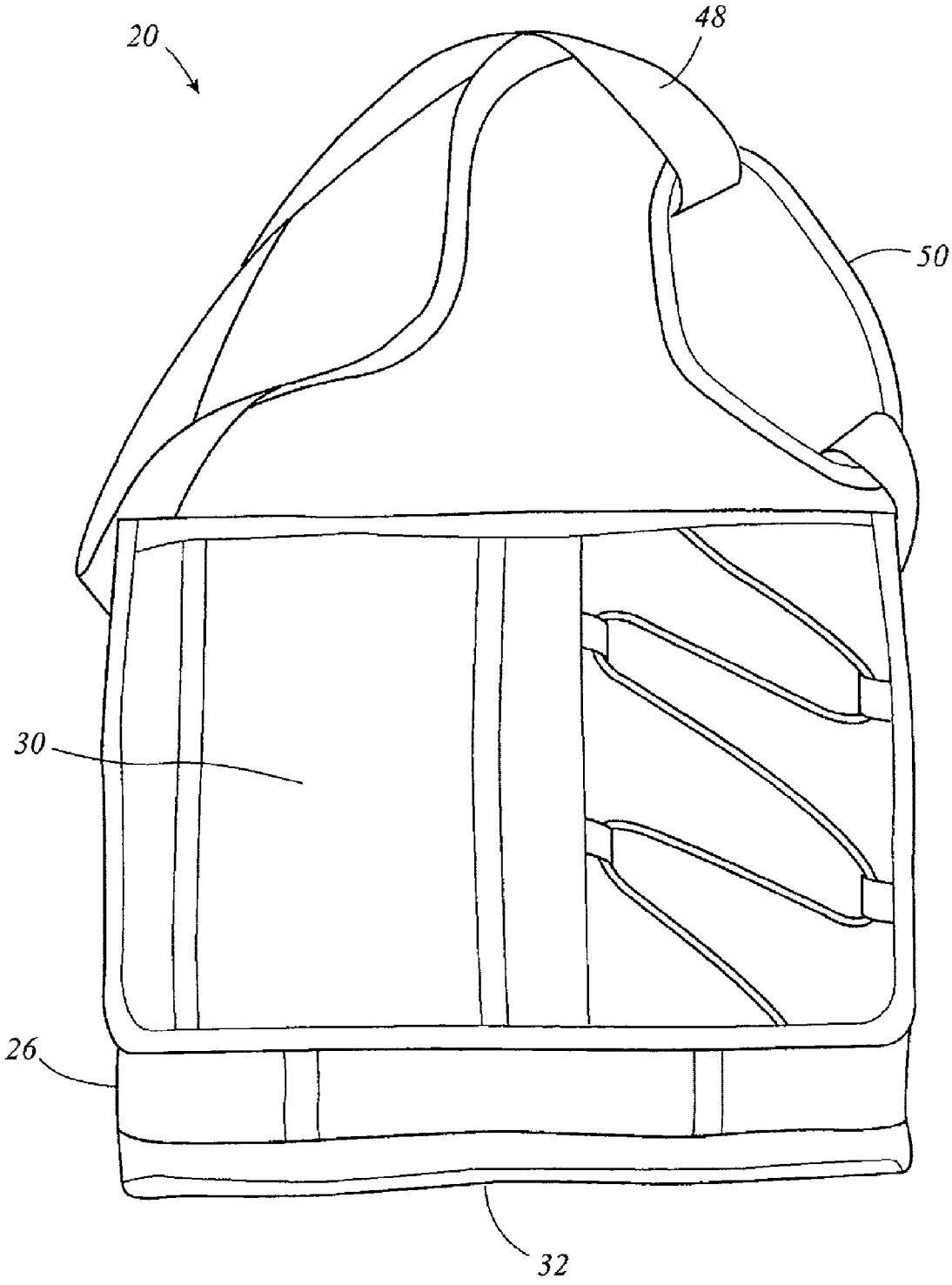
FIG. 2*a* is a front view of the insulated container assembly of FIG. 1*a*; in a collapsed or folded condition.
Figure 2B:
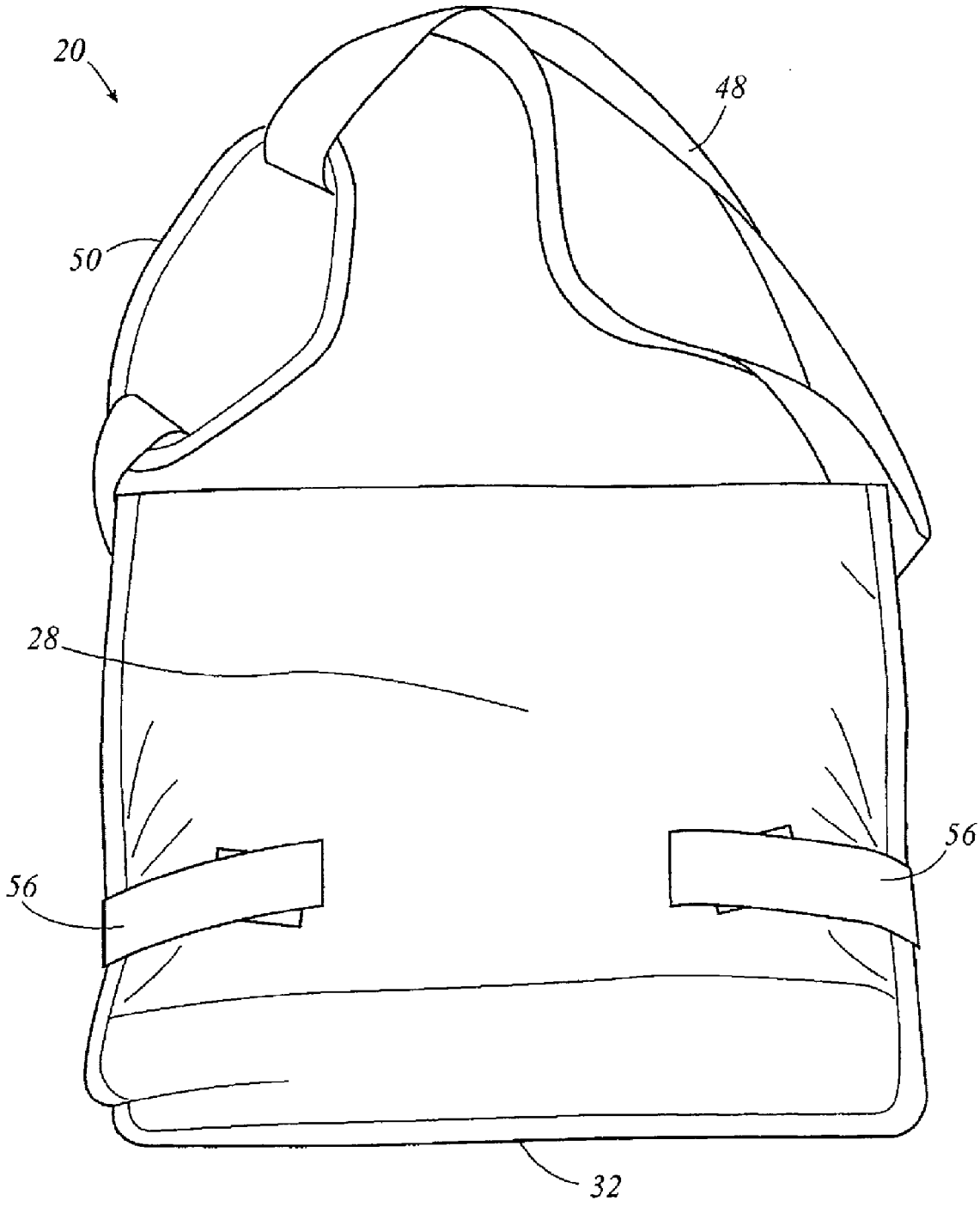
FIG. 2*b* is a rear view of the folded insulated container assembly of FIG. 2*a*.
Figure 2C:
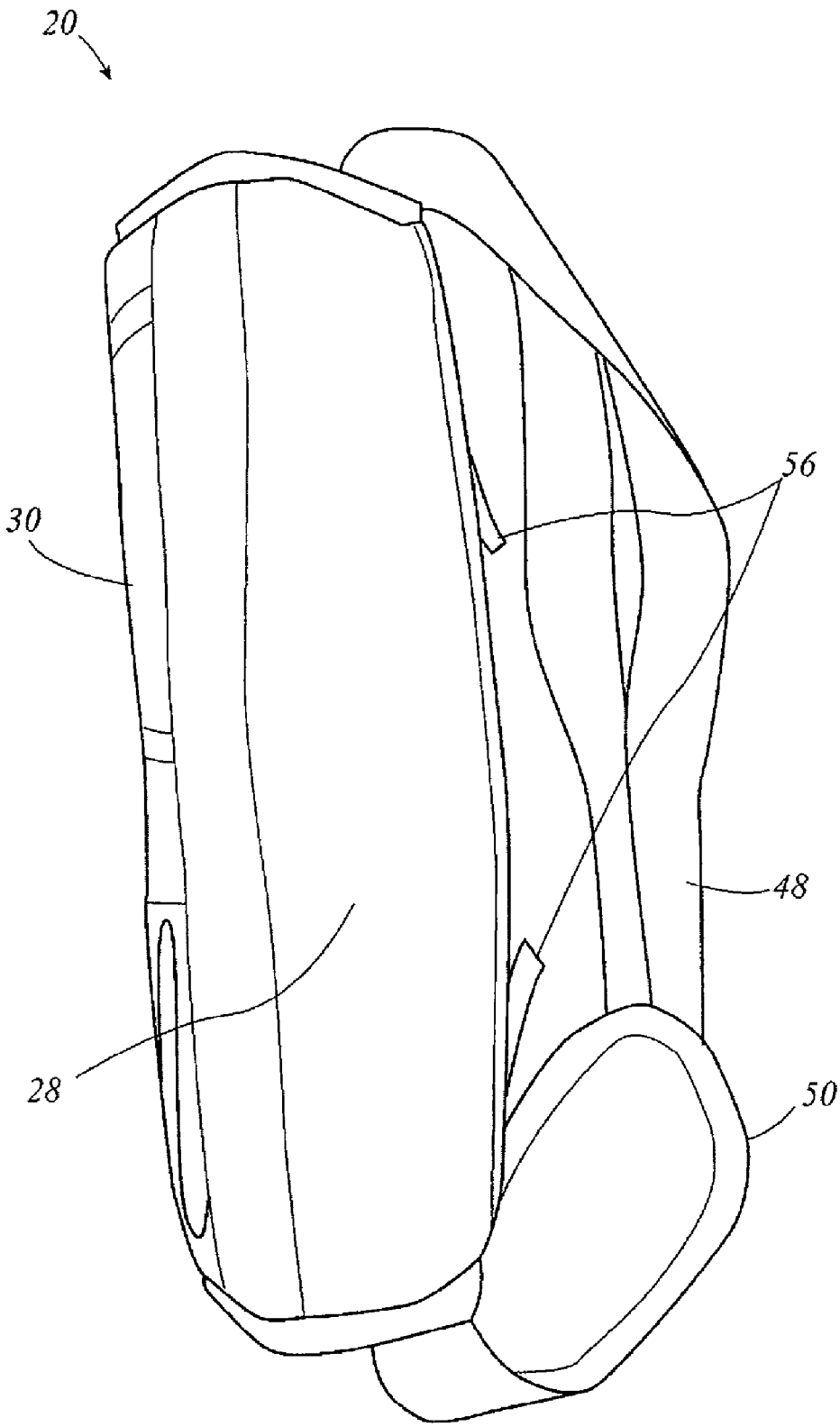
FIG. 2*c* is a top view of the folded insulated container assembly of FIG. 2*a*.
Figure 2D:
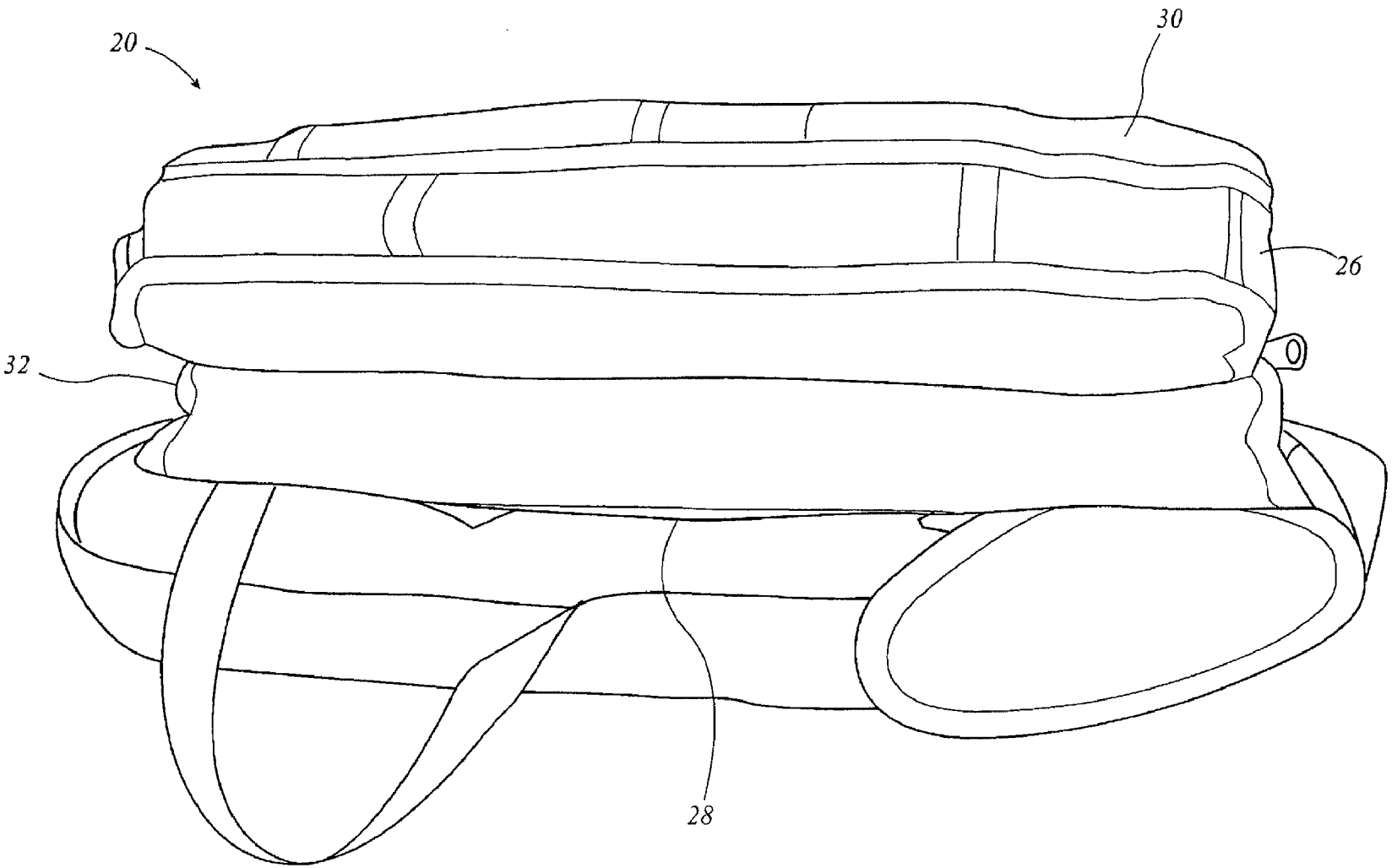
FIG. 2*d* is a bottom view of the doled insulated container assembly of FIG. 2*a*.
Figure 2E:
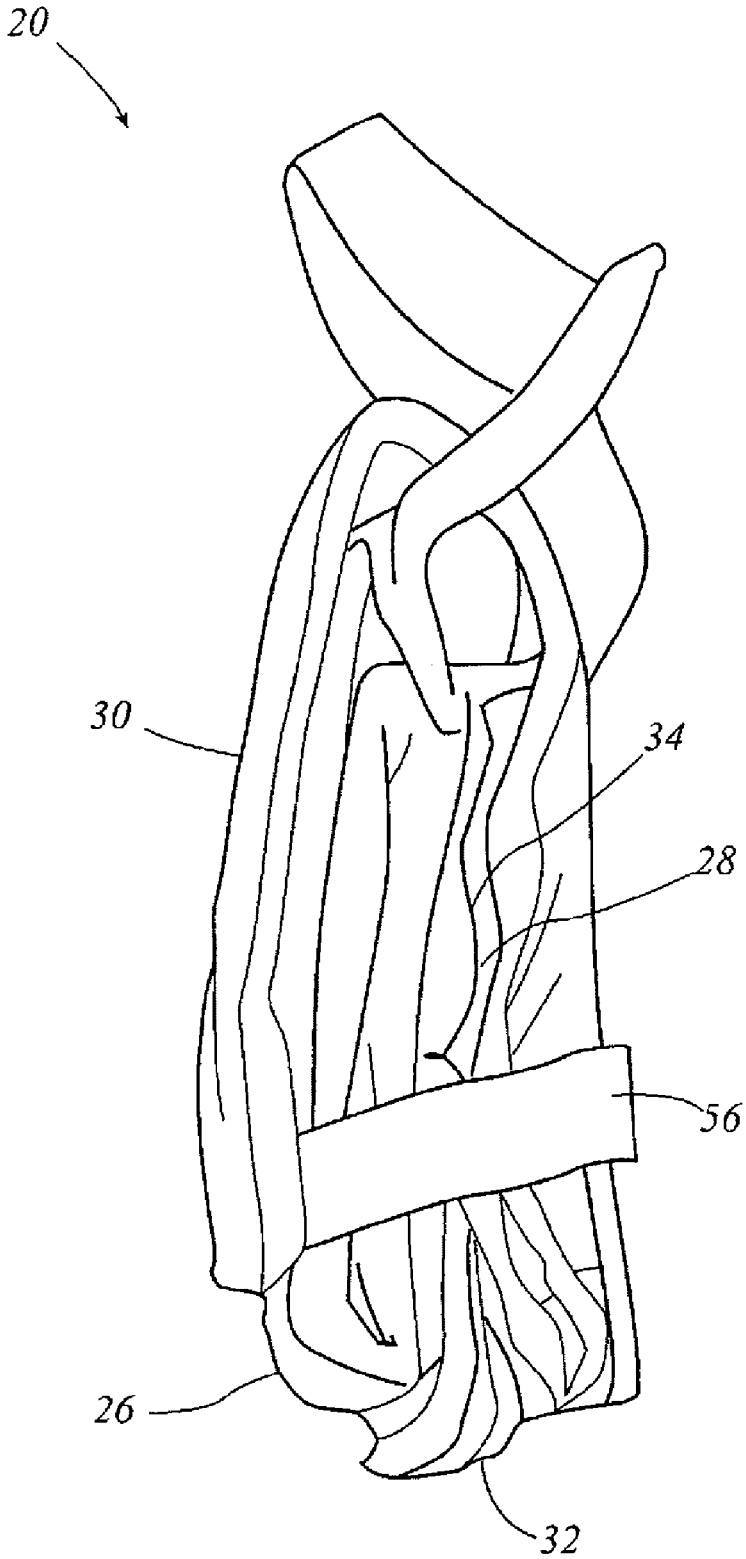
FIG. 2*e* is a right hand side view of the insulated container assembly of FIG. 2*a*.
Figure 2F:
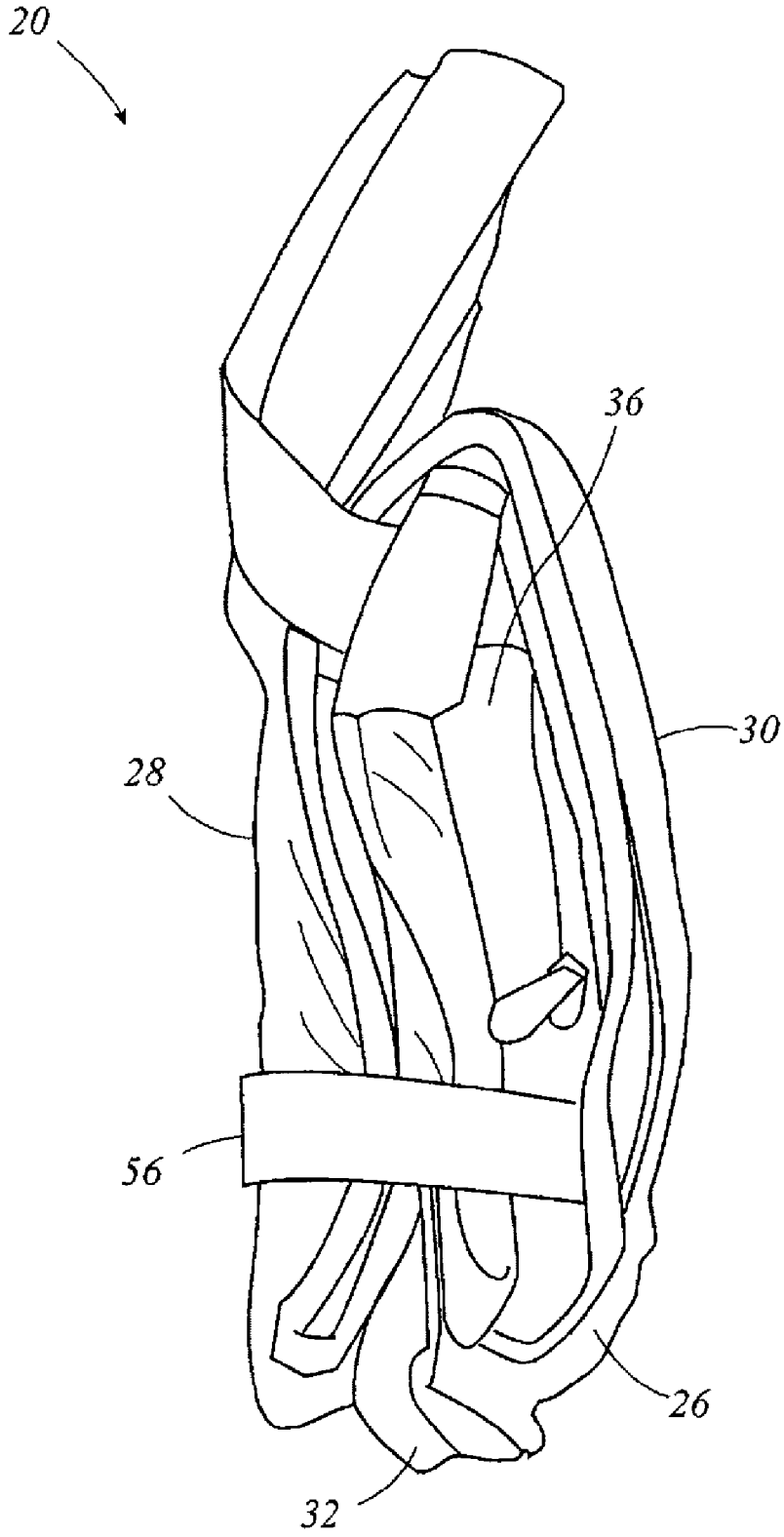
FIG. 2*f* is a left hand side view of the insulated container assembly of FIG. 2*a*.
Figure 3A:
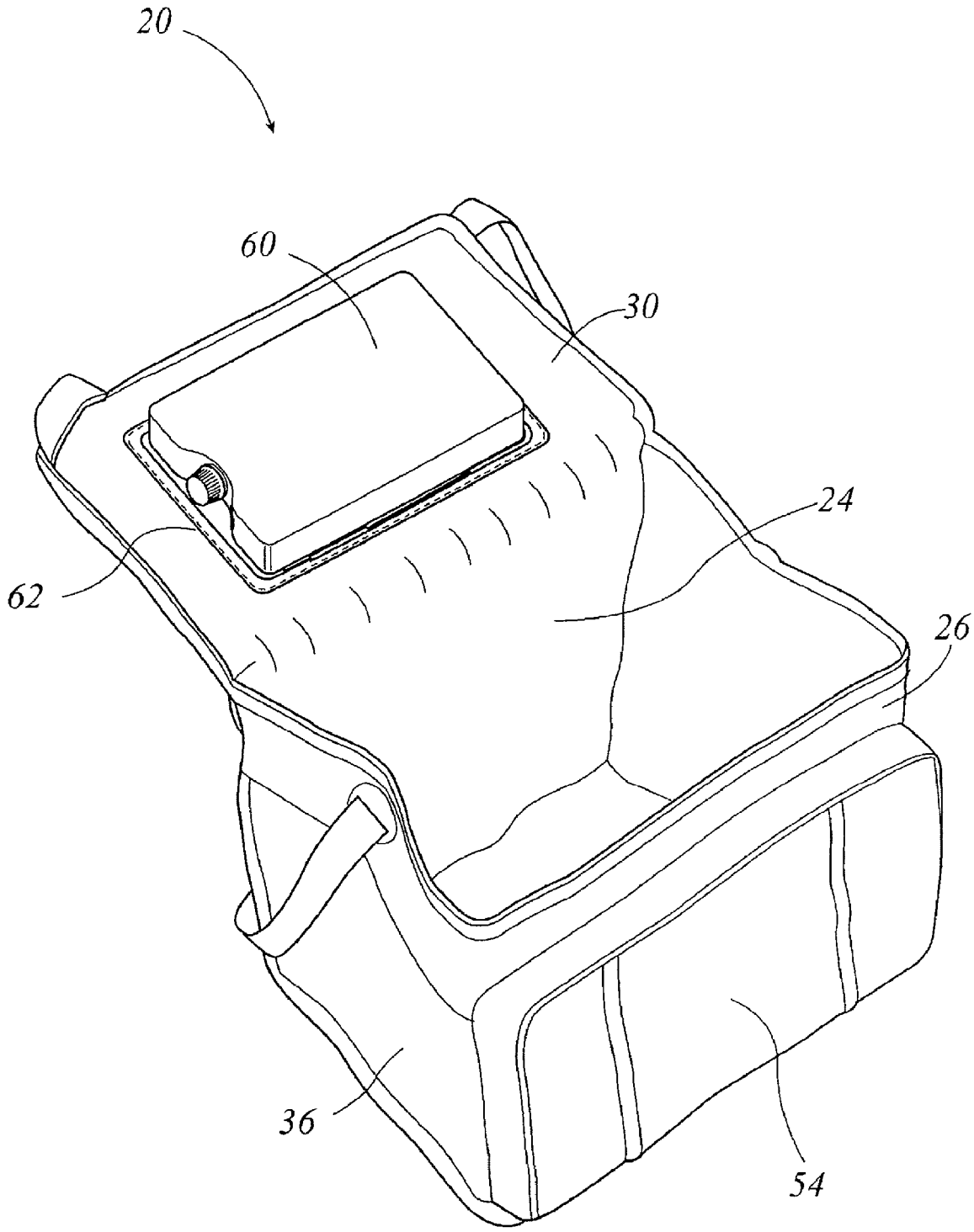
FIG. 3*a* shows the insulated container assembly of FIG. 1*a* in an expanded, open condition.
Figure 3B:
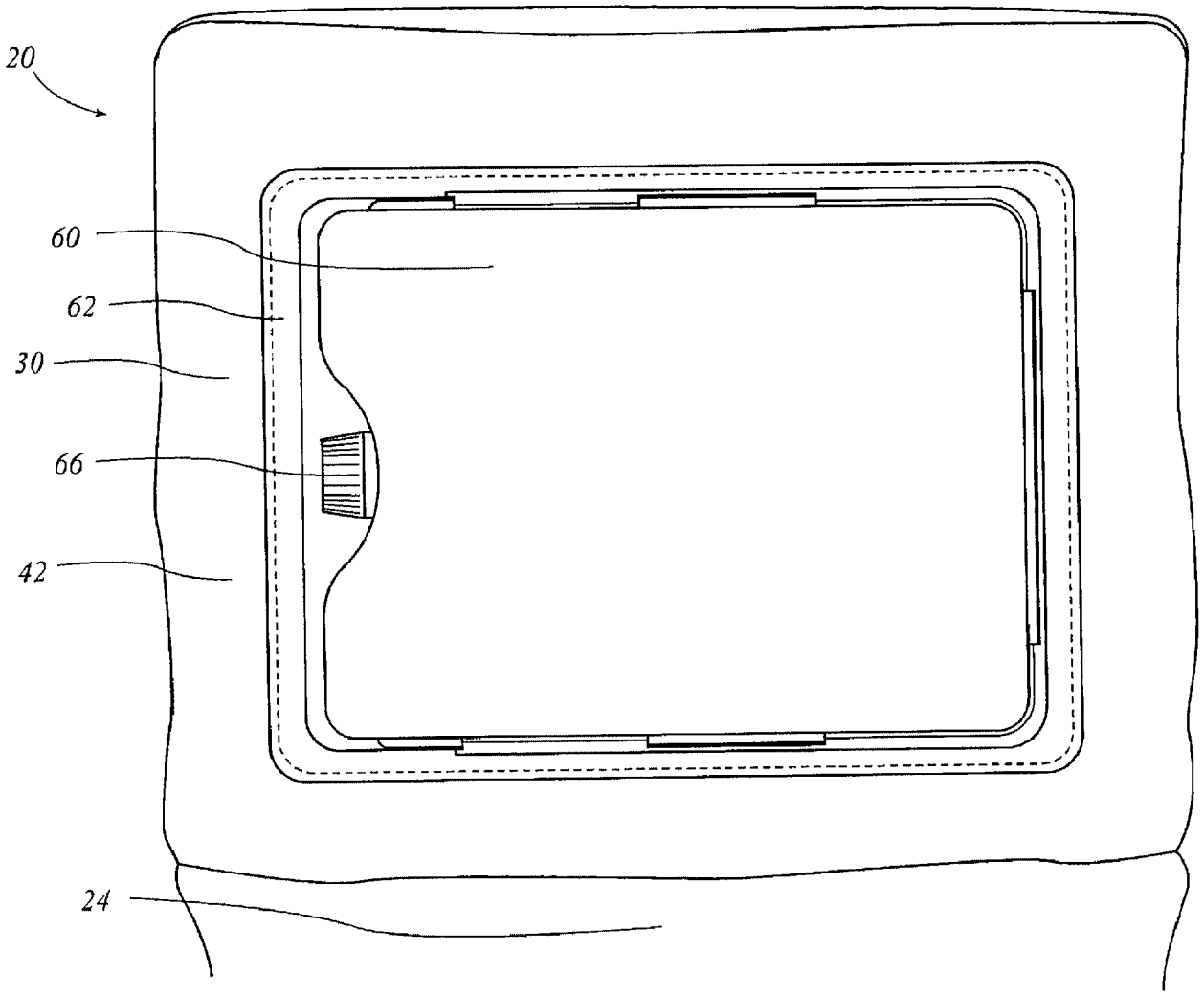
FIG. 3*b* is a plan view of the top panel of the assembly of FIG. 3*a* taken from inside with a thermal storage member in place.
Figure 3C:
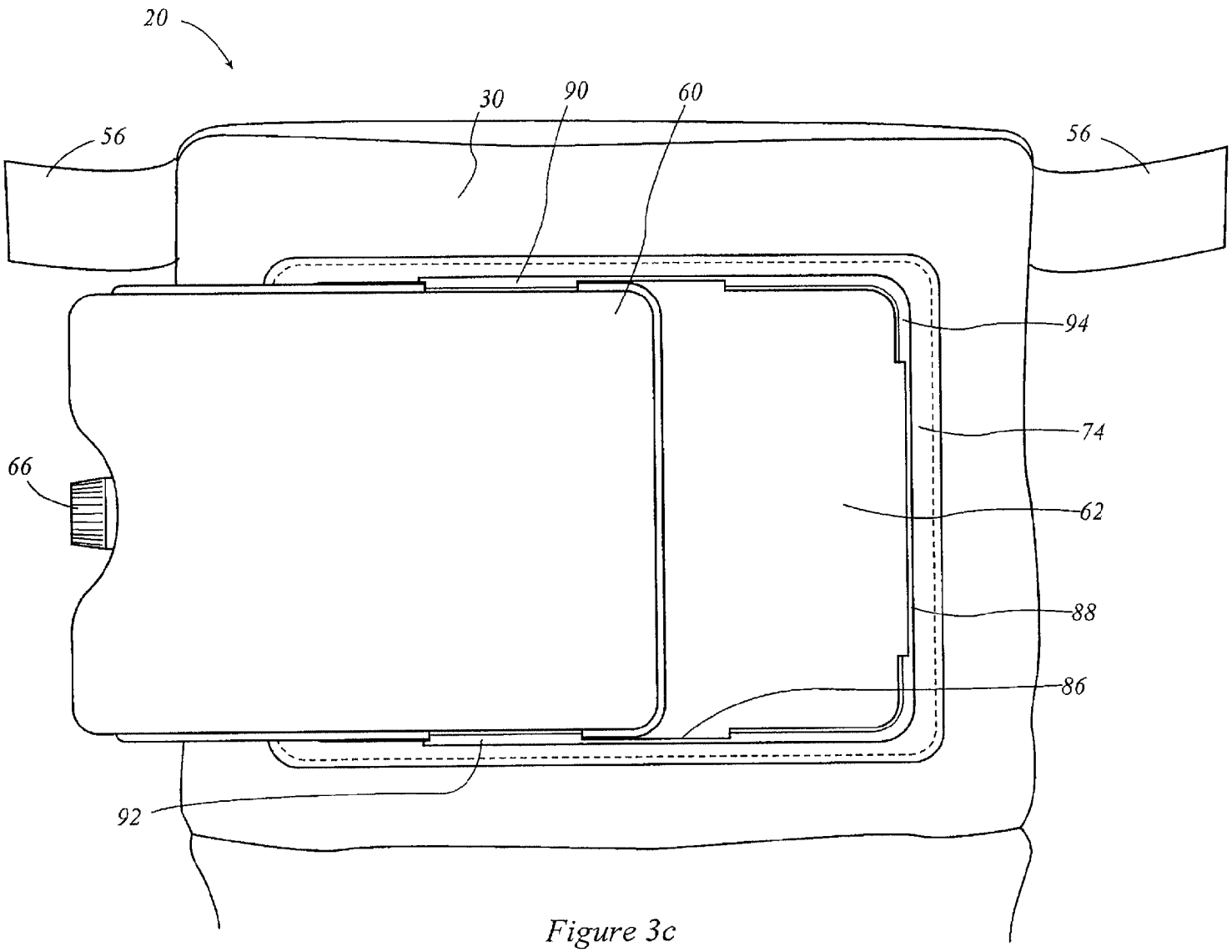
FIG. 3*c* is another plan view of the top panel of the assembly of FIG. 3*a* with the thermal storage member in a partially disengaged condition.
Figure 3D:
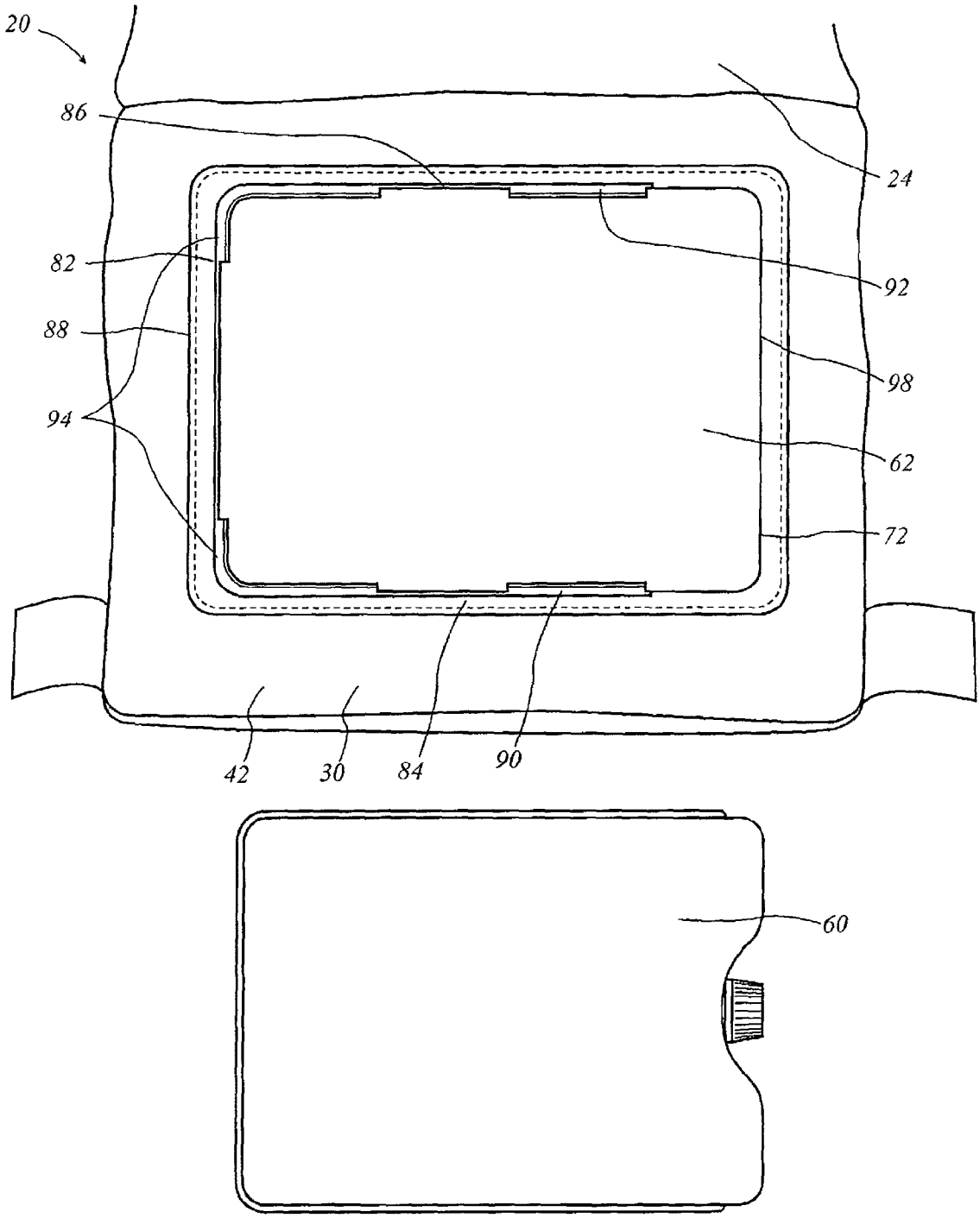
FIG. 3*d* is still another plan view of the top panel of FIG. 3*a* with the thermal storage member fully disengaged.
Figure 3E:
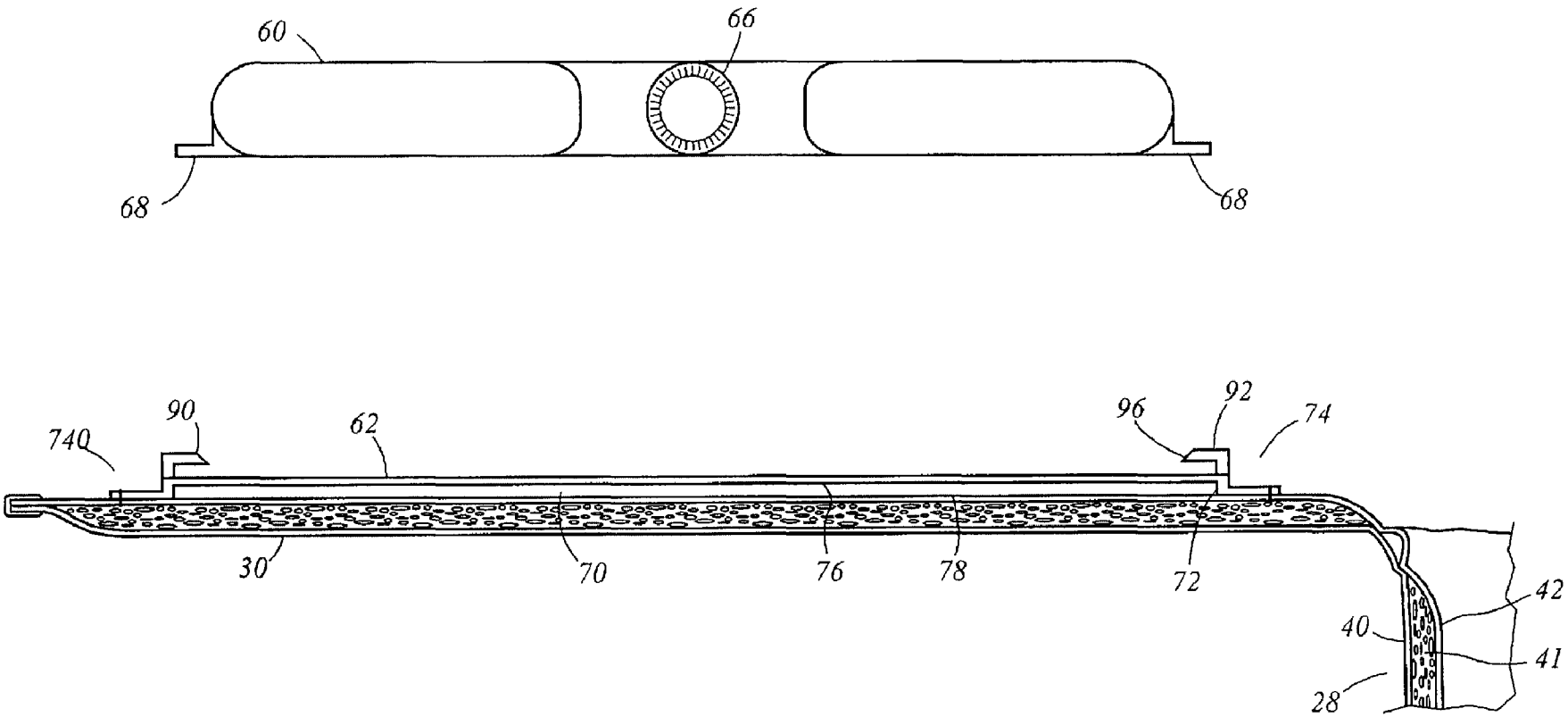
FIG. 3*e* shows an end view of the thermal storage member and a sectional view of the top panel of FIG. 3*b*.
Figure 3F:
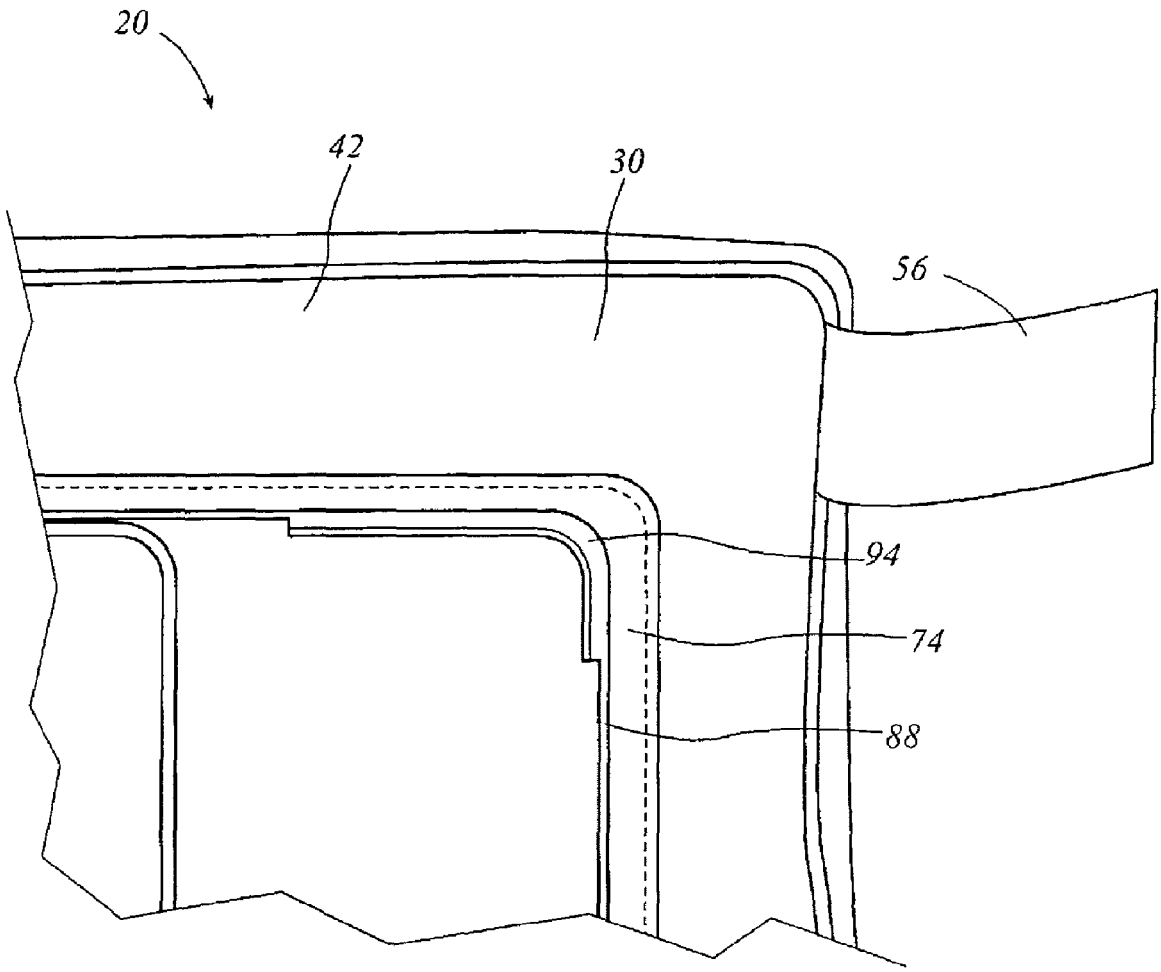
FIG. 3*f* is an enlarged plan view detail of the top panel of FIG. 3*b*.
Figure 3G:
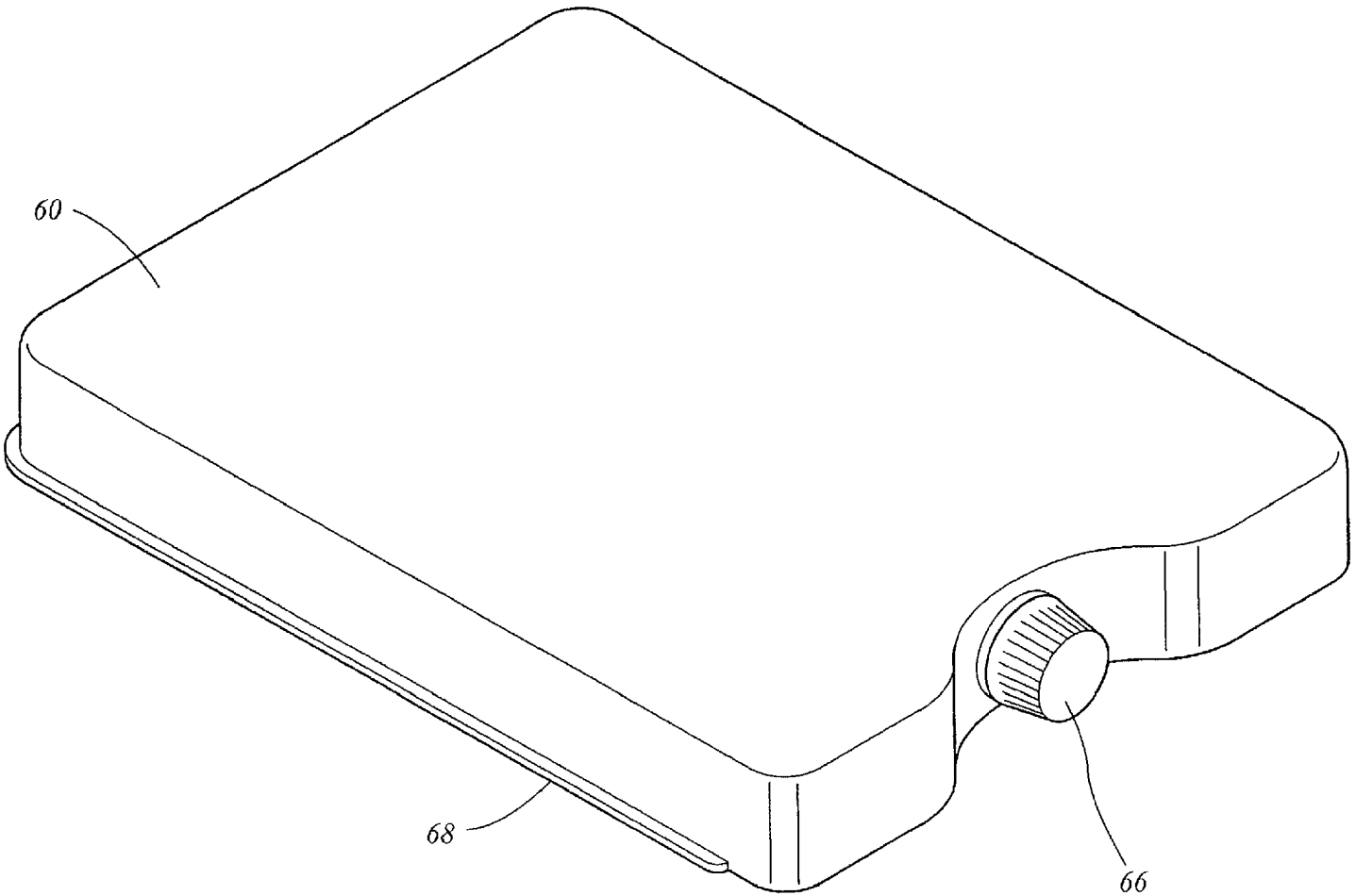
FIG. 3*g* is a perspective view of the thermal storage member of FIG. 3*e*.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated in order more clearly to depict certain features of the invention.

For the purposes of this description, it may be that a Cartesian frame of reference may be employed. In such a frame of reference, the long, or largest dimension of an object may be considered to extend in the direction of the x-axis; the base of the article, where substantially planar, may be considered to extend in an x-y plane; and the height of the article may be measured in the vertical, or z-direction. The largest panels of the containers described herein may be designated arbitrarily as the front and rear sides, or top and bottom sides, faces, or portions of the container. Similarly, the closure member, or opening is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which human food and human touch is accustomed, although the term cooler, or cooler container, or cooler bag, may be used, such insulated structures may generally also be used to keep food, beverages, or other objects either warm or hot as well as cool, cold, or frozen.

In this specification reference is made to insulated containers. The adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from Phillips v. AWH Corp., this definition provided in the specification is intended to supplant any dictionary definition, and to prevent interpretation in the US Patent Office (or in any other Patent Office) that strays from the customary and ordinary meaning of the term "insulated" as provided herein. The Applicant also explicitly excludes cellophane, waxed paper, tin foil, paper, or other single use disposable (i.e., not intended to be re-used) materials from the definition of "washable".

Similarly, this description may tend to discuss various embodiments soft-sided containers, as opposed to hard shell containers. In the jargon of the trade, a soft-sided cooler, or bag, or container, is one that does not have a substantially rigid, high density exoskeleton. A typical example of a container having a hard exoskeleton is on having a molded shell, e.g., of ABS or polyethylene, or other common types of molded plastic. Rather, a soft-sided container may tend not to be substantially rigid, but may rather have a skin that is flexible, or crushable, or sometimes foldable. By way of an example, which is not intended to be either exhaustive, comprehensive, exclusive or limiting, a soft-sided cooler may have an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam. In some examples, a soft-sided container may still be a soft-sided container where, as described herein, it may include a substantially rigid liner; may include one or more battens (which may be of a relatively hard plastic) concealed within the soft sided wall structure more generally; or may have hard molded fittings used either at a container rim or lip; or to provided a base or a mounting point for wheels, but where the outside of the assembly is predominantly of soft-sided panels. Once again, this commentary is intended to forestall the adoption by the US Patent Office, (or any other Patent Office), of an interpretation of the term "soft-sided" that diverges from the ordinary and customary meaning of the term as understood by persons of ordinary skill in the art in the industry, and as used herein.

The description may also refer to collapsible or foldable insulated containers. In the context of this specification, collapsible means intentionally collapsible, as, for example, being foldable along predetermined fold lines along which the container may, for example, be folded and unfolded several times. It is not intended to refer to something that is crushed, e.g., in a ball, in an arbitrary or indeterminate manner.

Referring to the general arrangement illustrations of FIGS. 1*a*-1*h* and 2*a*-2*f*, an example of an embodiment of a collapsible or foldable insulated container assembly is indicated generally as 20. The structure, and folding ability of this insulated container is substantially as shown and described in U.S. Pat. No. 6,238,091 of Mogil, issued May 29, 2001, which is incorporated herein by reference. The collapsible cooler assembly may or may not include the seamless folded liner shown and described in U.S. Pat. No. 6,238,091. Container assembly 20 has an insulated soft-sided wall structure 22 that defines an enclosure having an internal space, or volume, or chamber, or receptacle 24 into which objects may be placed with the objective of remaining cool (or warm) rather longer than might be the case if left exposed to outside ambient conditions. In this example, wall structure 22 may have the general form of a many sided box, such as a six-sided box, and those sides may be substantially rectangular to yield a box having a width $W_{20}$ in the x-direction, height $H_{20}$ in the z-direction, and a depth $D_{20}$ in the y-direction. The wall structure may then be considered as having walls or panels, those panels including a front panel 26, a rear panel 28, a top panel 30, a bottom panel 32, a right hand (or first end) panel 34, and a left hand (or second end) panel 36. The margins or edges, or vertices of the various panels meet such that the panels co-operate to define the overall enclosure structure. These panels may be substantially planar. Each panel may itself be considered to be a fabric, or web, structure, and may have an outer skin 40, an inner skin 42, and a layer of soft (i.e., readily flexible) insulating foam 41 sandwiched between skins 40, 42. The outer skin may be a woven material, such as woven nylon. The inner skin may be a substantially continuous layer of plastic sheet, and may tend therefore to yield an ability to contain liquid within the chamber to at least to some extent.

Assembly 20 includes a main closure 44 that is movable between open and closed positions to govern access to the inside of receptacle 24. In this instance, the upper panel, namely top panel 30 may include of define a movable lid, hingedly attached to the upper margin of rear panel 28, and releasably attached to the upper margins of front panel 26 and end panels 34 and 36, as for example, by employment of a tracked fastener, or zipper 46 that extends around those three sides.

Assembly 20 may include such other features as a lifting member, such at may have the form of a strap 48, which may, in one example be secured to either end wall 34, 36 at ring fittings. Strap 48 may include a load spreading pad 50. It may also include a secondary wall structure 52 (which may or may not be insulated) defining an external chamber or pocket, or pouch, and another, external closure member 54. Further, it may include an external securement, such as an elasticised strap, or bungee cord. It may also include temporary attachment members in the nature of left and right straps 56 with hook and eye fabric fastener pad or strips (i.e., such as sold under the brand name "Velcro") having a root in the distal marginal portion of the lid and a free end for mating which pads 58 on rear panel 28.

In assembly 20, bottom panel 32 and end wall panels 34, 36 fold upward and inward respectively to permit front panel 26 and rear panel 28 to be brought closer together, and to permit top panel 30 to lie across the front face of front panel 26, as shown in the collapsed condition or position in FIGS. 2*a*-2*f* In this condition, top panel 30, or a significant portion of top panel 30, remains in a generally flat or substantially planar condition. In this embodiment, panels 32, 34 and 36 may be considered folding panels, whereas panels 26, 28 and 30 are substantially not folded, but remain generally flat, in an approximate way, i.e., it may be a somewhat lumpy flatness.

In this embodiment, the lid defined by top wall 30 has an extent (i.e., a footprint) substantially equal to that of bottom panel 32. This need not be the case. Lid 26 could be a small opening set in a larger top panel, or could be an opening of half, or some other portion of the panel. The opening need not extend fully along three sides of lid 26, but could extend along part of one or two sides as may be found suitable in a particular use.

Typical sizes for assembly 20 may be 12 can, 20 can, or 30 cans. A reference size of can is roughly 341 ml (roughly 12 oz.) and having a diameter of 66 mm and a height of 125 mm., typically being a beverage can for soft drinks, this being a common size of drink can in North America. Larger, or smaller, embodiments are possible.

Turning now to FIGS. 3*a*-3*g*, there is a thermal storage member 60 located in a frame, or carrier, or seat, 62, that is in turn mounted on the inside (i.e., the side facing inwardly toward the interior of the cooler when the lid is closed) of top panel 30. In this embodiment, top panel 30 may not otherwise include (i.e., may be free of) any other stiffening member.

Thermal storage member 60 may be an hollow vessel that contains a charge of a thermal storage medium. The thermal storage medium may be water, and the thermal storage may be obtained through a phase change i.e., from liquid to solid, and solid back to liquid. Other media could be used. Water may be relatively safe and convenient. Thermal storage member 60 may include a port and closure 66 by which to introduce or remove the thermal storage medium. Thermal storage member 60 may also include seat engagement fittings which may be in the nature of protruding flanges, rails, or slide members 68. Permanently sealed thermal storage members may also be used.

Seat 62 may be a monolithic molded platic member. Seat 62 may be a substantially planar member, in which the through thickness, $t_{62}$, is small relative to both the length, $L_{62}$ and the width $W_{62}$. Seat 62 may tend to have a shape corresponding in size and plan form to top panel 30, though smaller, such that there is an inset from the periphery of the top panel to seat 62. As in the instance illustrated, that plan form may be four-sided, and may be rectangular, having a pair of opposed long sides and a pair of opposed short sides, or margins. Seat 62 has a substantially planar spanning or central portion 70, a step 72, and a peripheral flange or margin 74. Central spanning portion 70 is a relatively thin membrane. Seat 62 has a first, or inward facing surface, 76, and a second, or outward facing surface 78. Flange 74 may be of a thickness to permit it to be sewn to inner skin 42. That is, it is either thin enough to be sewn through, or is provided with apertures for that purpose. The surface of central portion 70 may be bounded on three sides by members defining a seat 80 standing outwardly proud of spanning central portion 70, the boundaries of seat 80 being defined by a set of retention fittings or guides, which may also be termed a retainer, or retainers, indicated generally as 82. The retainer fittings 82 may include a three sided horseshoe-shaped peripheral retaining wall having first and second parallel side edge portions 84, 86, and an end wall portion 88. Capture members in the nature of flanges or flange portions 90, 92 and 94 may extend from the distal or top edge of the edge portions inwardly to form a three sided channel or slot, or track, or guideway 96. It may be noted that one end of this peripheral wall is left open, as indicated at 98. It may also be noted that the plane of the guideway is completely separate from, and does not interfere with, the plane or zone, of the peripheral flange 74 for mating with inner skin 42. Notably, step 72 serves not only as a peripheral stiffening flange, but also as a stand-off, or pedestal by which central portion 70, and therefore guideway 96, are located somewhat more distantly proud of skin 42, such that insertion of slide members 68 is facilitated. That is, the plane (or planes) of action of base 62 of thermal storage member 60 and its guides or slides mat be substantially parallel to the plane of panel 30 more generally, but spaced proud thereof to facilitate sliding entry without obstruction or interference. Further, while this commentary is made in the context of planar panels, the panels need not be planar, but could be, for example, cylindrical as formed on a body of revolution, the point being that the relationship of the panel surface and the thermal storage member is such as to permits sliding engagement of the ways an a direction predominantly across, or cross-wise relative to the panel surface. In the specific example the motion occurs in planes or surfaces to which the normal vector of the panel is also normal. In some embodiments, the mouth of the guideway 96 may have a flare, or taper, or chamfer, to facilitate introduction of the thermal storage member rails.

The predominantly cross-wise or parallel motion may be considered in light of the assembly shown in U.S. Pat. No. 7,162,890 of Mogil. In that assembly, the direction of engagement is predominantly, if not precisely, normal to the plane of the lid panel. Most typically the user engages the nubbins or studs or blisters of one end of the thermal storage member in the associated indents of one end of the bezel. (The bezel is, by definition, a rigid peripheral frame or setting array, such as for holding a gem stone, a display panel or computer screen cover, and so on.) The other end of the thermal storage member is then pivoted to mate the blisters at the other end with their associated detents in a snap fit. However, this may require a certain manual dexterity, and may be easier for some than others, particularly after the consumption of some beverages is well advanced. Further, the freezing of water in the thermal storage member vessel may tend slightly to alter the geometric relationship of the blisters and detents, which may increase the difficulty of installing and removing the unit. By contrast, a lateral, or cross-wise, or sideways, sliding motion may be comparatively advantageous. It may also be advantageous for the seat to be free of a snap fit element that may otherwise be more strongly prone to mis-fit.

In the embodiment shown, the thermal storage member is mounted on the inside of the lid of top panel 30 of the unit. This may be advantageous for a number of reasons. First, to the extent that thermal storage unit 60 is used for cooling, a position above the objects to be cooled may be advantageous. Further, where lid 30 is held in place by a friction fit or by Velcro™, the weight of thermal storage member 60 (when filled with the thermal storage medium) may assist in keeping lid 30 closed. Lid 30 may also be the most convenient position for permitting a change of the thermal storage member 60 without having to repack the objects to be cooled. However, it is not necessary that this be so. Seat 62 could be mounted on one of side panels 26, 28, 34, 36, permitting a vertical insertion and extraction (or, more generally, an extraction in a direction generally along the direction of introduction and extraction of objects into or out of the insulated internal chamber space generally). Also, the placement of seat 62 and thermal storage member 60 in one of the non-folding panels (namely the front panel, the rear panel, and the greater portion of the top panel) does not detract from or otherwise significantly impair, the collapsibility or foldability function.

In the embodiment of FIGS. 4*a* to 4*f*, we see a container assembly 120 that is substantially the same as container assembly 20, but differs therefrom insofar as it includes a top panel, or lid, 122 that has both a main closure, such as may be secured on one side at the hinge between the rear panel and the top panel, and on the other three marginal edges of the top panel by a tracked fastener, namely a zipper. It also has a secondary or auxiliary closure member 130. Secondary closure member 130 may be formed within, or as a portion of lid 122, and may have the form of a flap, which may be a generally rectangular flap, such as flap 132. The underside of the distal margin of flap 132 may have a releasable securement fitting, be it a snap, or such other means as a fabric hook-and-eye fastening strip (i.e., Velcro™).

Figure 4A:
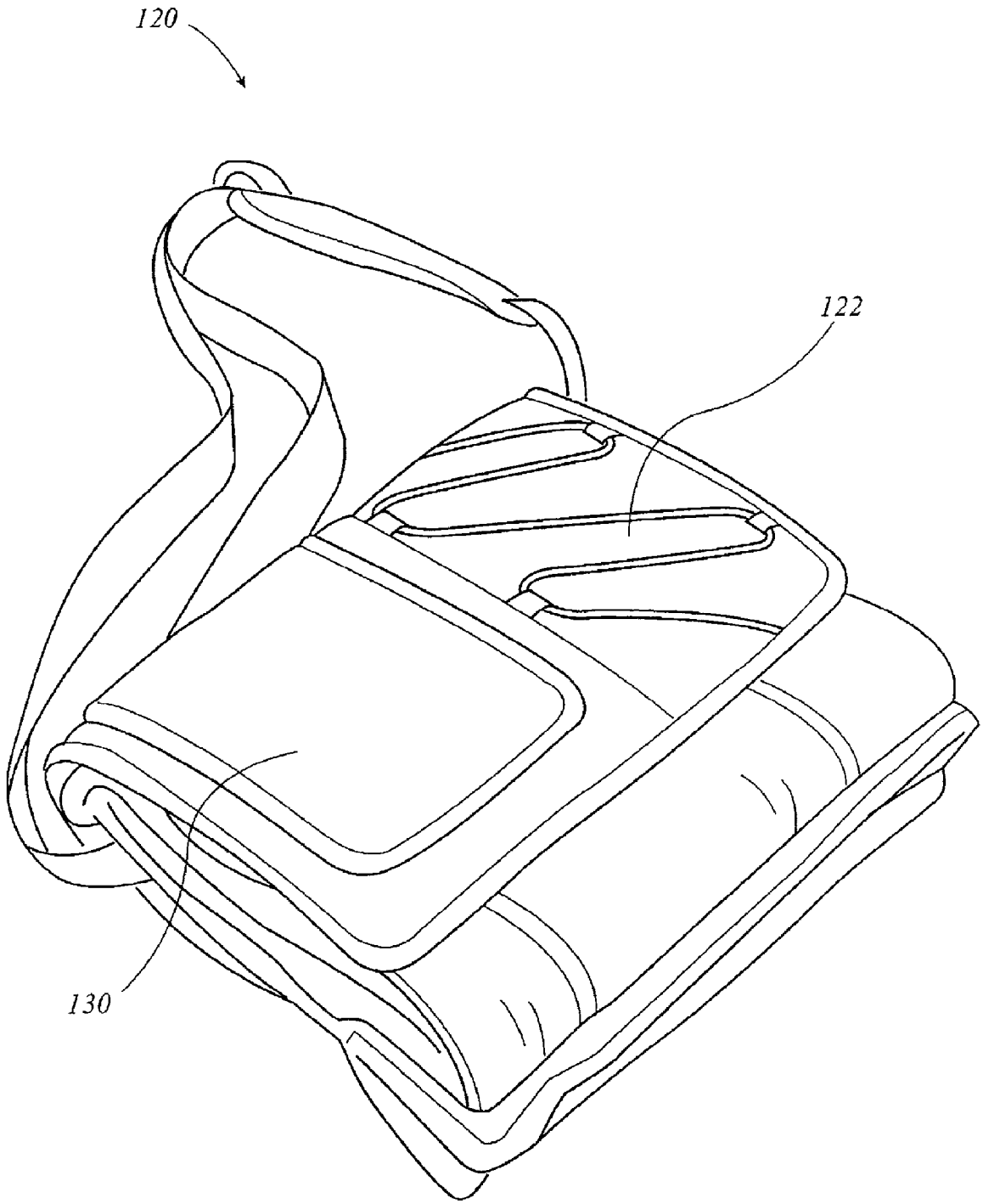
FIG. 4*a* is a perspective view of an alternate embodiment of collapsible, or foldable insulated container assembly to that of FIG. 1*a*, in a folded condition.
Figure 4B:
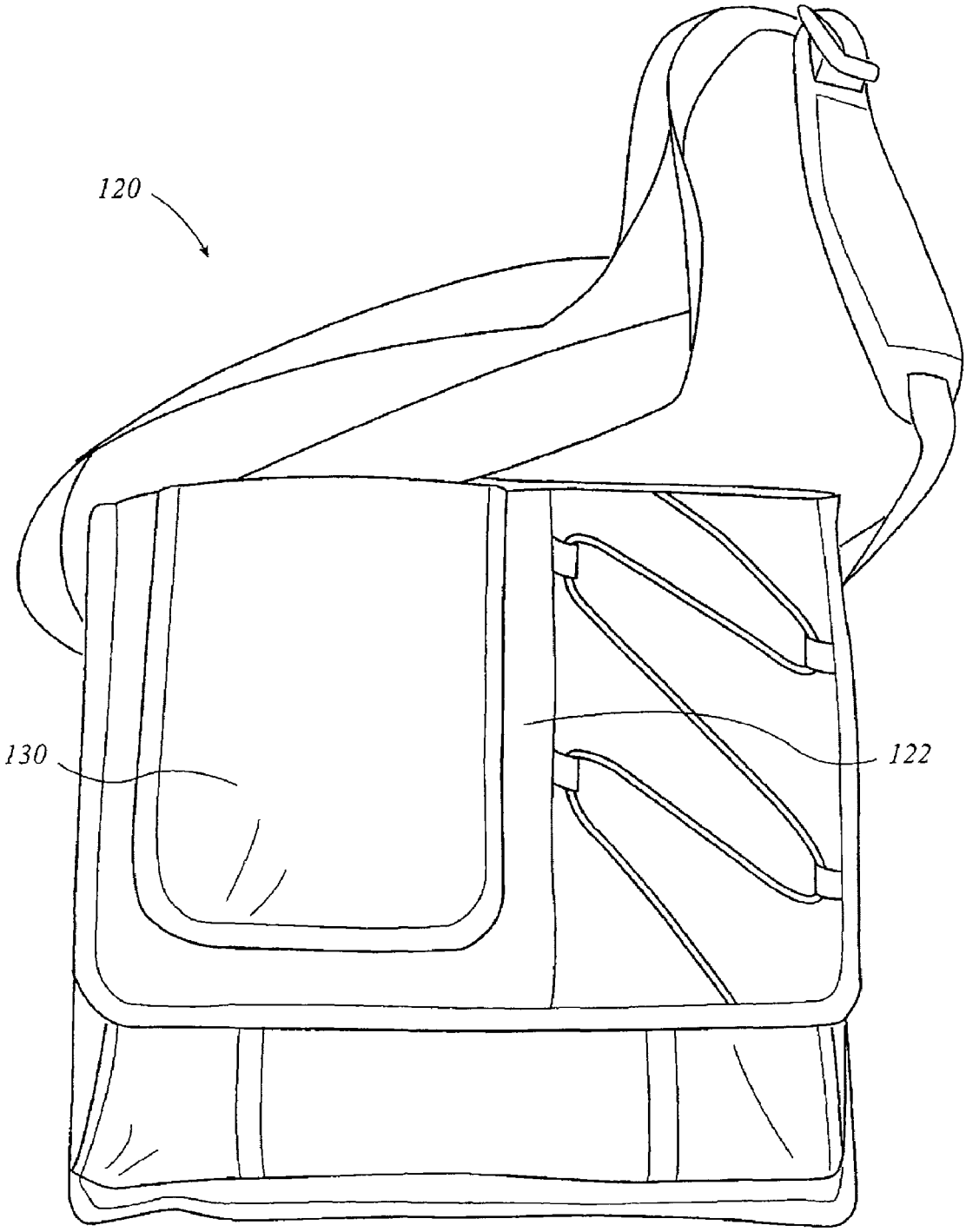
FIG. 4*b* is a front view of the foldable insulated container assembly of FIG. 4*a*.
Figure 4C:
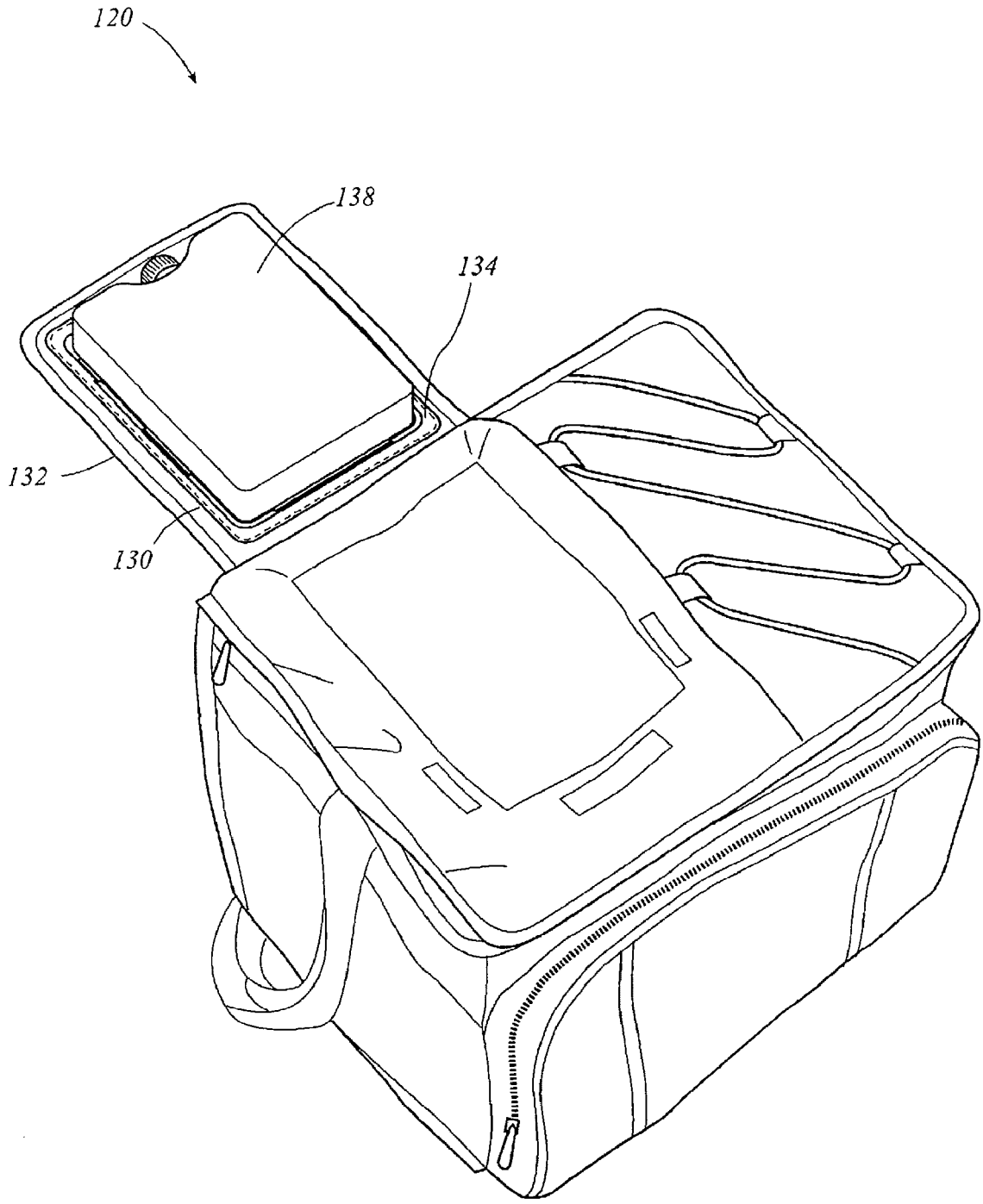
FIG. 4*c* is a perspective view of the foldable insulated container assembly of FIG. 4*a* in an expanded condition with a closure member open to show a thermal storage member.
Figure 4D:
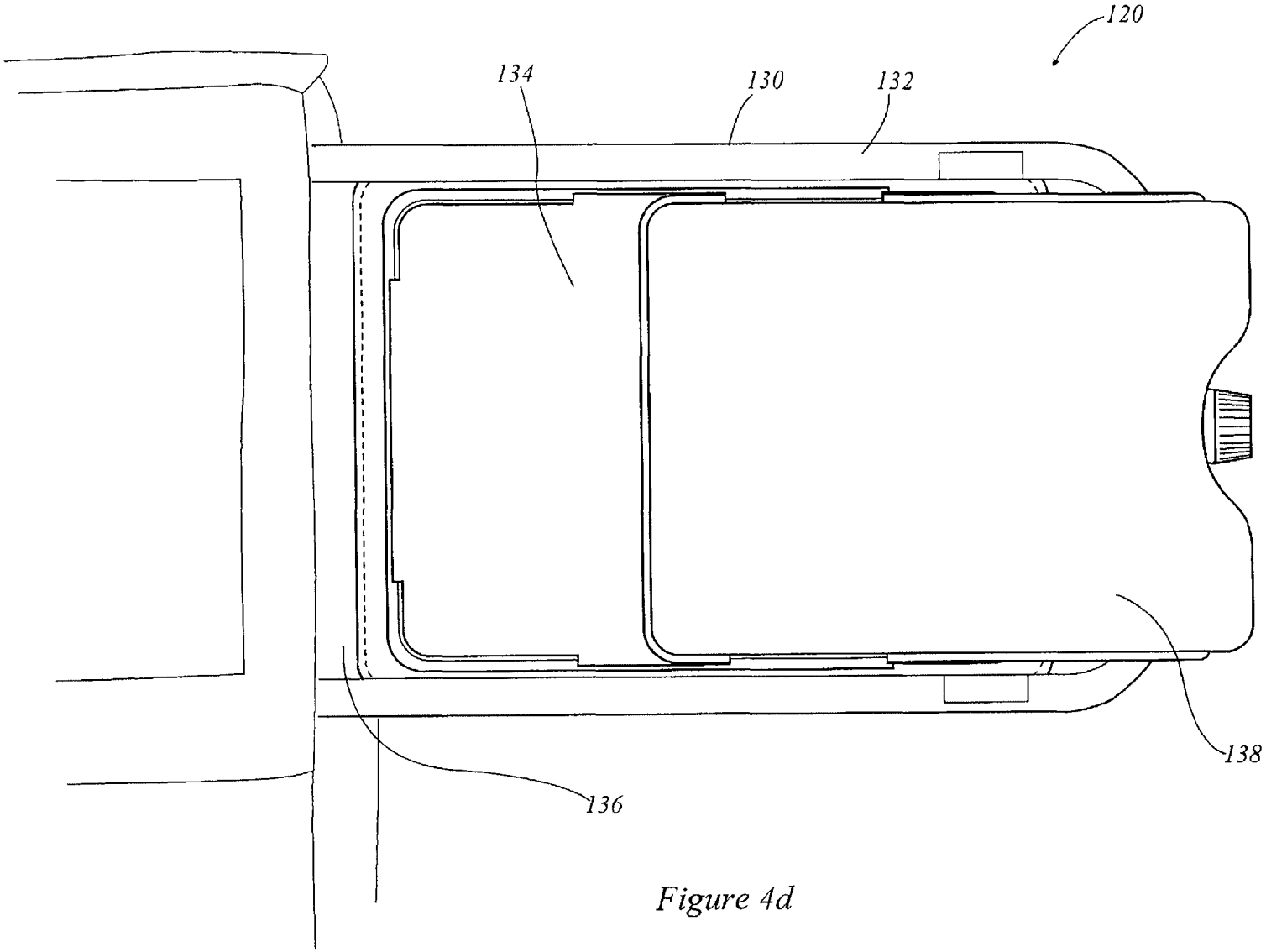
FIG. 4*d* shows the thermal storage member of FIG. 4*c* in a partially engaged (or partially disengaged) condition.
Figure 4E:
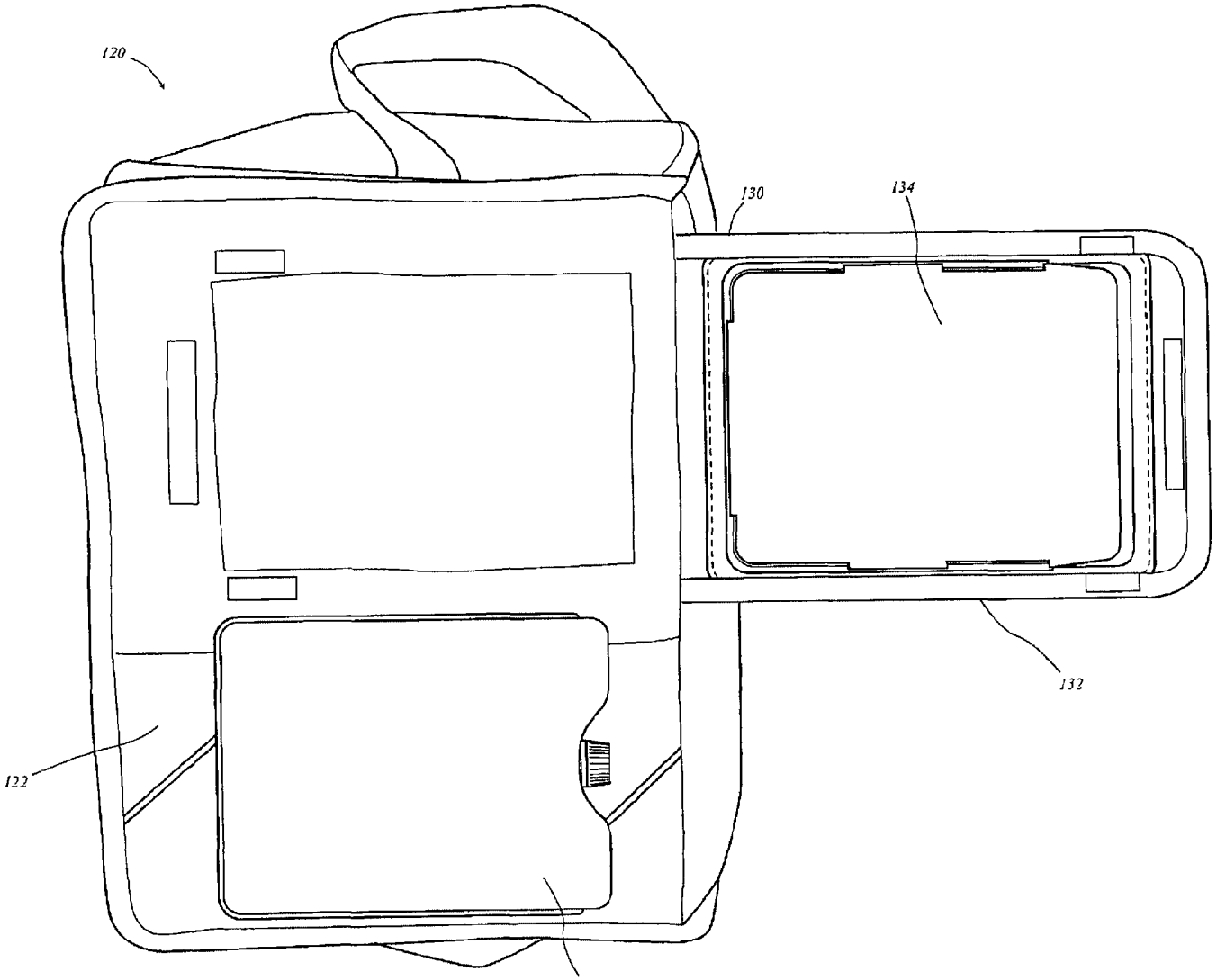
FIG. 4*e* shows the thermal storage member in a fully disengaged condition.
Figure 4F:
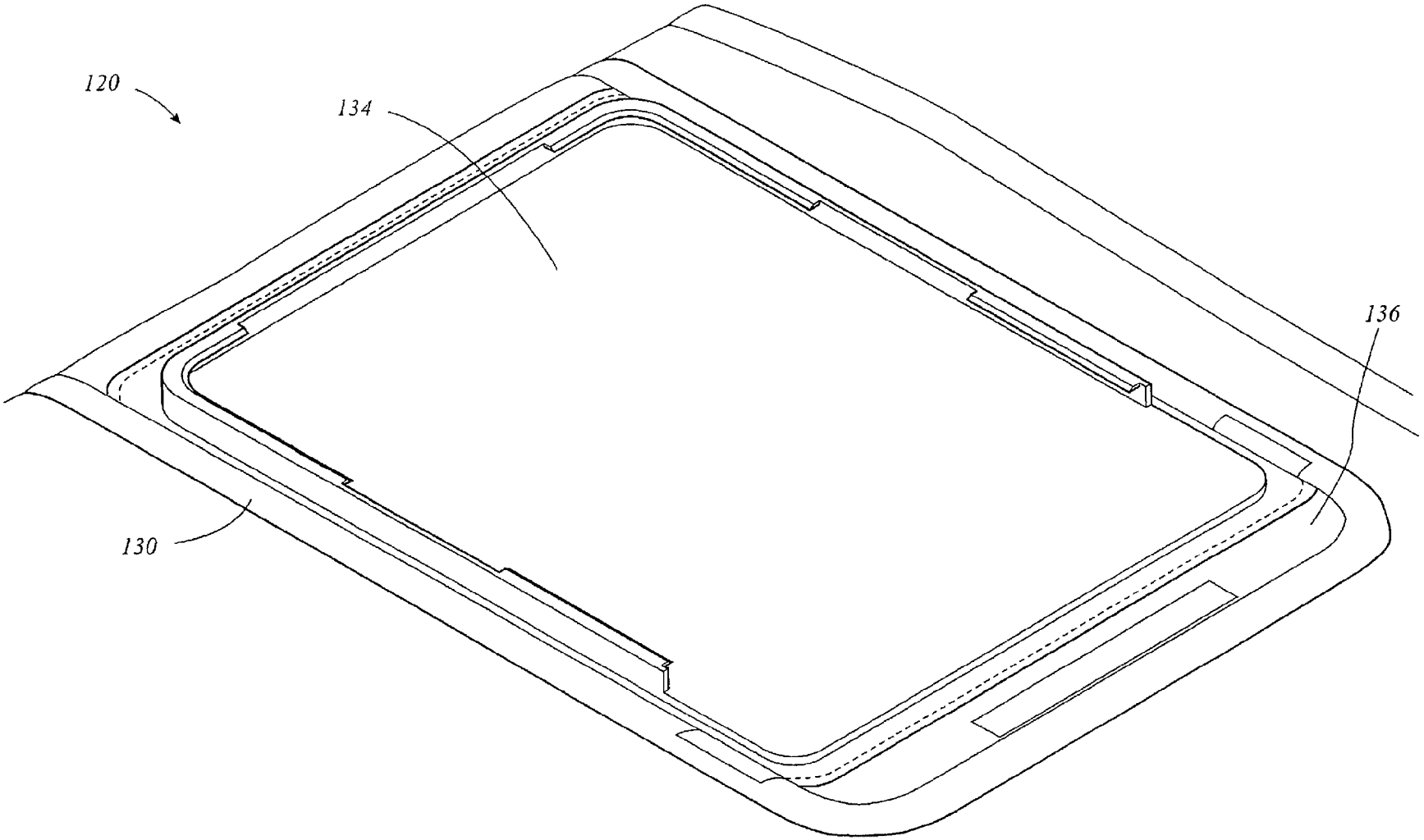
FIG. 4*f* shows an enlarged perspective detail view of the closure member of FIG. 4*c* showing the seat, or carrier for the thermal storage member.

As seen in the successive views of FIGS. 4*d*, 4*e* and 4*f*, a carrier, or seat assembly 134 is mounted to the inside skin 136 of flap 132 in substantially the same manner (e.g., by sewing) as described above in the context of seat 62. A thermal storage member 138 engages the seat as shown, in the same manner as described above. In this instance, the flap, or movable closure member, is still movable between a first or closed position or condition as shown in FIGS. 4*a*, 4*b*, and 4*c*; and a second or open position or condition as shown in FIGS. 4*d*, 4*e*, and 4*f*. This closure is a zipperless closure, and the weight of the thermal storage element (when charged with the thermal storage medium) may tend to assist in maintaining the zipperless closure in its closed position. The thermal storage element is thus deployed in an easily accessible location for replacement, as may be desired from time to time, with the outward sliding direction being away from the hinge of the flap, and the sliding motion being unobstructed by the lip of the flap.

In the embodiments shown, the host panel to which the thermal storage member carrier, i.e., seat 62, is mounted is not otherwise reinforced or stiffened, and the collapsible container assembly does not include (i.e., is free of) other rigid supporting structure. Thus the benefit of having a lid mounted cooling block, as achieved in U.S. Pat. No. 7,162,890 is also achieved in these embodiments, while still retaining the foldability function that is lost when a rigid liner is used as in U.S. Pat. No. 7,162,890.

Embodiments incorporating the various aspects and features of the invention have been described in detail and a number of alternatives have been considered. As changes in or additions to the above described embodiments may be made without departing from the nature, spirit or scope of the invention, the invention is not to be limited by or to those details, but only by the appended claims.

I claim:

1. A collapsible, soft-sided insulated container assembly comprising:

a soft sided insulated wall structure including a plurality of sides mutually connected along vertices, said wall structure having folds along which said wall structure may be moved between a first position, that first position being a folded position, and a second position, that second position being an expanded position in which said wall structure defines an insulated chamber of said container into which an object may be placed, said wall structure including a closure member movable between open and closed conditions to govern access to said insulated chamber;

said wall structure including a first fabric wall portion having a width, a breadth, and a thickness, said thickness being less than half of either said width and said breadth;

said first fabric wall portion including an inner skin, an outer skin, and a layer of insulation located between said inner skin and said outer skin;

a substantially rigid thermal storage member;

a substantially rigid thermal storage member seat;

said thermal storage member seat including a land conforming to said first fabric wall portion of said wall structure and being mounted adjacent said inner skin thereof such that said thermal storage member seat is, in use, oriented inwardly relative to said insulated chamber;

said thermal storage member seat including a guide, said guide being mounted proud of said inner skin of said fabric wall portion; and said thermal storage member being slidingly engageable with said guide in a direction predominantly cross-wise to said first fabric wall portion.

2. The collapsible, soft-sided insulated container assembly of claim 1 wherein said first fabric wall portion is oriented such that when said closure member is in said open condition said thermal storage member is exposed and slidably disengageable from said guide.

3. The collapsible, soft-sided insulated container of claim 1 wherein said first fabric wall portion defines a lid panel of said container assembly.

4. The collapsible, soft-sided container assembly of claim 1 wherein said thermal storage member seat includes a pair of guide members defining a track, and said thermal storage member has mating fittings operable to engage and run along said track.

5. The collapsible, soft-sided container assembly of claim 1 wherein said first fabric wall portion remains substantially flat when said assembly is moved to said first position.

6. The collapsible, soft-sided container assembly of claim 1 wherein said first fabric wall portion is a sub-portion of a larger wall panel.

7. The collapsible soft-sided container assembly of claim 1 wherein:

said first fabric wall portion is substantially planar and defines a top wall of the assembly, said top wall being hingedly movable to define said closure member;

said seat being substantially planar;

said seat being mounted to, and being substantially parallel to, said top wall; and said thermal storage member being movable substantially sideways relative to said top wall to engage and disengage said seat.

8. The collapsible soft-sided container assembly of claim 4 wherein:

said first fabric wall portion is substantially planar and defines a top wall of the assembly, said top wall being hingedly movable to define said closure member;

said seat being substantially planar;

said seat being mounted to, and being substantially parallel to, said top wall; and said thermal storage member being movable substantially sideways relative to said top wall to engage and disengage said seat.

* * * * *